US009476184B2

(12) United States Patent
Wallis et al.

(10) Patent No.: US 9,476,184 B2
(45) Date of Patent: Oct. 25, 2016

(54) EXCAVATOR WEAR ASSEMBLY

(71) Applicant: CQMS PTY LTD, Mackay (AU)

(72) Inventors: Douglas Wallis, Mackay (AU); Miguel Guimaraes, Mackay (AU); Bruce Lilley, Mackay (AU); Josua Kirsch, Mackay (AU); Edwin Schuetz, Mackay (AU)

(73) Assignee: CQMS PTY LTD (AU)

( * ) Notice: Subject to any disclaimer, the term of this patent is extended or adjusted under 35 U.S.C. 154(b) by 0 days.

(21) Appl. No.: 13/814,707

(22) PCT Filed: Dec. 10, 2012

(86) PCT No.: PCT/AU2012/001511

§ 371 (c)(1),
(2) Date: Mar. 5, 2013

(87) PCT Pub. No.: WO2013/082678

PCT Pub. Date: Jun. 13, 2013

(65) Prior Publication Data

US 2013/0333254 A1 Dec. 19, 2013

(30) Foreign Application Priority Data

Dec. 8, 2011 (AU) ..... 2011905123
Jun. 22, 2012 (AU) ..... 2012902643

(51) Int. Cl.
*E02F 9/28* (2006.01)

(52) U.S. Cl.
CPC ..... *E02F 9/2833* (2013.01); *E02F 9/2825* (2013.01); *E02F 9/2841* (2013.01); *Y10T 29/49947* (2015.01)

(58) Field of Classification Search
USPC ..... 37/456, 457, 458
IPC ..... E02F 9/2833
See application file for complete search history.

(56) References Cited

U.S. PATENT DOCUMENTS

| | | | | | |
|---|---|---|---|---|---|
| 2,368,611 | A | * | 1/1945 | Charnock | 403/326 |
| 3,749,449 | A | * | 7/1973 | Krekeler | 299/102 |
| 3,774,324 | A | | 11/1973 | Lafond | |
| 3,839,805 | A | | 10/1974 | Stepe | |
| 3,959,901 | A | * | 6/1976 | Klett | 37/452 |
| 3,967,361 | A | | 7/1976 | Merkel et al. | |
| 3,982,339 | A | | 9/1976 | Nilsson | |
| 4,096,653 | A | * | 6/1978 | Kaarlela et al. | 37/457 |
| 4,182,058 | A | | 1/1980 | Poncin | |

(Continued)

FOREIGN PATENT DOCUMENTS

| | | | |
|---|---|---|---|
| AU | 2003264586 | A1 | 7/2004 |
| AU | 2005203574 | C1 | 3/2007 |

(Continued)

*Primary Examiner* — Gary Hartmann
(74) *Attorney, Agent, or Firm* — Leydig, Voit & Mayer, Ltd.; John Augustyn

(57) ABSTRACT

A lock assembly to lock two members together, typically an excavator wear member, such as a tooth, on to an adaptor. The lock assembly has a locking pin with a flange portion and a retaining assembly that receives the locking pin. The retaining assembly includes a locking member, in the form of a locking ring, which deforms radially when a tapered portion of the locking pin is inserted into the retaining assembly. In the locked position, the locking ring engages with the flange portion of the locking pin to prevent withdrawal of the locking pin from the retaining assembly.

17 Claims, 29 Drawing Sheets

(56) References Cited

U.S. PATENT DOCUMENTS

| | | | | |
|---|---|---|---|---|
| 4,231,173 | A | 11/1980 | Davis | |
| 4,233,761 | A | 11/1980 | Ryerson | |
| 4,338,736 | A | 7/1982 | Radigan | |
| 4,404,760 | A | 9/1983 | Hahn et al. | |
| 4,464,090 | A * | 8/1984 | Duran | F16B 41/002 411/103 |
| 4,481,728 | A | 11/1984 | Mulder et al. | |
| 4,587,751 | A | 5/1986 | Sjogren et al. | |
| 4,716,668 | A | 1/1988 | Hahn | |
| 4,823,486 | A * | 4/1989 | Diekevers et al. | 37/456 |
| 4,848,013 | A | 7/1989 | Bowman et al. | |
| 4,903,420 | A | 2/1990 | Kreitzberg et al. | |
| 4,918,843 | A * | 4/1990 | Kiesewetter et al. | 37/457 |
| 4,919,566 | A * | 4/1990 | Caron et al. | 404/121 |
| 4,932,478 | A | 6/1990 | Jones | |
| 5,009,017 | A * | 4/1991 | Diekevers et al. | 37/456 |
| H0000946 | H * | 8/1991 | Lonn | 404/121 |
| 5,077,918 | A | 1/1992 | Garman | |
| 5,088,214 | A | 2/1992 | Jones | |
| 5,172,500 | A | 12/1992 | Renski et al. | |
| 5,172,501 | A | 12/1992 | Pippins | |
| 5,205,057 | A | 4/1993 | Garman et al. | |
| 5,272,824 | A | 12/1993 | Cornelius | |
| 5,337,495 | A | 8/1994 | Pippins | |
| 5,399,053 | A | 3/1995 | Duran | |
| 5,423,138 | A | 6/1995 | Livesay et al. | |
| 5,469,648 | A | 11/1995 | Jones et al. | |
| 5,653,048 | A | 8/1997 | Jones et al. | |
| 5,709,043 | A | 1/1998 | Jones et al. | |
| 5,718,070 | A | 2/1998 | Ruvang | |
| 5,765,301 | A * | 6/1998 | Clendenning | 37/457 |
| 5,855,052 | A * | 1/1999 | Becker | B25B 23/0085 29/243.519 |
| 5,918,391 | A | 7/1999 | Viñas Peya | |
| 5,937,550 | A | 8/1999 | Emrich | |
| 5,937,551 | A | 8/1999 | Moehnke et al. | |
| 5,956,874 | A | 9/1999 | Ianello et al. | |
| 6,018,896 | A | 2/2000 | Adamic | |
| 6,052,927 | A | 4/2000 | Pippins | |
| 6,092,958 | A | 7/2000 | Gale | |
| 6,108,950 | A | 8/2000 | Ruvang et al. | |
| 6,119,378 | A | 9/2000 | Pippins | |
| 6,439,796 | B1 | 8/2002 | Ruvang et al. | |
| 6,467,203 | B2 | 10/2002 | Pippins | |
| 6,467,204 | B1 | 10/2002 | Creighton et al. | |
| 6,735,890 | B2 | 5/2004 | Carpenter et al. | |
| 6,959,506 | B2 | 11/2005 | Adamic et al. | |
| 7,100,315 | B2 | 9/2006 | Carpenter et al. | |
| 7,178,274 | B2 | 2/2007 | Emrich | |
| 7,377,735 | B2 * | 5/2008 | Cosenza | F16B 41/002 411/353 |
| 7,707,755 | B2 * | 5/2010 | Lopez Almendros et al. | 37/457 |
| 7,762,015 | B2 | 7/2010 | Smith et al. | |
| 2002/0000053 | A1 | 1/2002 | Adamic et al. | |
| 2003/0070330 | A1 | 4/2003 | Olds et al. | |
| 2004/0139632 | A1 | 7/2004 | Robinson et al. | |
| 2007/0209189 | A1 | 9/2007 | Lopez Almendros et al. | |
| 2007/0256335 | A1 | 11/2007 | De Martiis | |
| 2011/0000109 | A1 | 1/2011 | Woerman et al. | |
| 2012/0260539 | A1 * | 10/2012 | Guimaraes et al. | 37/452 |
| 2012/0260540 | A1 * | 10/2012 | Guimaraes et al. | 37/453 |

FOREIGN PATENT DOCUMENTS

| | | | |
|---|---|---|---|
| AU | 2009238226 | C1 | 10/2009 |
| CA | 2161505 | A1 | 4/1997 |
| DE | 2620142 | | 11/1977 |
| GB | 1308037 | | 2/1973 |
| JP | 2000-104293 | A | 4/2000 |
| WO | WO 2004/027272 | A2 | 4/2004 |
| WO | WO 2008/116942 | A1 | 10/2008 |
| WO | WO 2009/127016 | A1 | 10/2009 |
| WO | 2011/069183 | | 6/2011 |

* cited by examiner

EXCAVATOR WEAR ASSEMBLY

CROSS-REFERENCE TO RELATED APPLICATIONS

This patent application is a U.S. National Phase of International Patent Application No. PCT/AU2012/001511, filed Dec. 10, 2012, which claims the benefit of Australian Patent Application No. 2012902643, filed Jun. 22, 2012, and Australian Patent Application No. 2011905123, filed Dec. 8, 2011, which are incorporated by reference.

FIELD OF THE INVENTION

The invention relates to an excavator wear assembly. In particular, although not exclusively, the invention relates to an assembly for releasably securing an excavator tooth to a nose of an excavator.

BACKGROUND TO THE INVENTION

Excavator tooth assemblies mounted to the digging edge of excavator buckets and the like generally comprise a replaceable digging tooth, an adaptor body and an adaptor nose which is secured by welding or the like to the digging edge of a bucket or the like. The tooth generally has a socket-like recess at its rear end to receivably locate a front spigot portion of the adaptor nose and a removable locking pin is generally employed to releasably secure the tooth on the adaptor.

In use, excavator teeth are subjected to extensive load forces along a longitudinal axis of a tooth as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/tooth combination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, twisting or "yaw" loads are frequently imposed on such tooth assemblies.

Despite many prior art attempts to improve the mounting of a wear member to a nose of an excavator, most of these proposals suffer from one or more deficiencies. As described hereinafter, many of the prior art references relate to direct mounting of a tooth onto a nose without an intermediate adaptor but in those assemblies, the mounting systems for securing teeth directly onto excavator noses is considered analogous to the mounting of a tooth onto an adaptor.

U.S. Pat. No. 4,182,058 describes an excavator tooth having a rearwardly divergent tapering socket to receive a nose having a complementary-shaped front spigot portion. Resistance to rotational moment forces is borne by a resilient steel cotter pin extending through aligned vertical apertures in the socket and spigot portions.

U.S. Pat. Nos. 3,774,324, 4,338,736, 4,481,728, 4,903,420, 5,469,648, 7,100,315 and 6,735,890 all describe nose and tooth combinations wherein the nose has a generally convergently tapering spigot portion with a forward tip having a box-like configuration with at least the upper and lower surfaces thereof having faces parallel to each other and to a longitudinal axis of the nose portion. With the exception of U.S. Pat. No. 4,338,736, which describes a transverse locking pin, each of the tooth mounting arrangements is heavily reliant on a large vertical locking pin to resist rotational moment forces tending to rotate the teeth off respective noses.

U.S. Pat. No. 4,231,173 describes a tapered adaptor nose having a box-like free end, which engages in a mating box-like socket cavity to resist rotational moments. Opposed pairs of rearwardly extending tongues engage in corresponding recesses in the outer surfaces of the adaptor nose to resist rotational movements. Because the tongues themselves are unsupported, they possess a limited capacity to resist rotational moment forces.

U.S. Pat. No. 5,272,824 describes a structure similar to that of U.S. Pat. No. 4,231,173 except that the side tongues are of more robust dimensions and the upper and lower tongues are formed as box-like members with apertures to receive a vertical mounting pin passing through aligned apertures in the tooth and adaptor nose.

U.S. Pat. No. 4,404,760 provides flat rail surfaces on the adaptor nose to engage with mating grooves in the socket aperture of a corresponding tooth wherein the mating rail and groove surfaces are generally parallel to the longitudinal axis of the tooth.

U.S. Pat. No. 5,423,138 describes a generally tapered nose having a box-like front end with upper and lower transverse surfaces generally parallel to a longitudinal axis of a tooth which located directly thereon. The parallel upper and lower transverse surfaces are contiguous with upper and lower rail surfaces on each side of the nose and parallel to the longitudinal axis of the tooth. A pair of rearwardly extending side tongues locate in recesses formed in the outer side faces of the nose, ostensibly to resist rotational moment forces in the tooth. Because the side tongues are recessed to accommodate the side rail portions, the robustness of the side tongues is somewhat compromised.

U.S. Pat. No. 4,233,761 describes a fairly stubby tapered nose having a box-like front portion with upper and lower surfaces generally parallel to a longitudinal axis of an excavator tooth, an intermediate rearwardly diverging tapered portion and a rear portion having upper and lower surfaces extending generally parallel to a longitudinal axis of the tooth. Formed on the upper and lower surfaces of the front, intermediate and rear portions of the nose are spaced parallel reinforcing ribs which are located in mating grooves in the excavator tooth. A large vertical locking pin extends through aligned apertures in the tooth and nose between the reinforcing ribs. This structure is heavily reliant on the locking pin to resist rotational moment forces however it is considered that this configuration may be prone to failure in the rear portion of the adaptor.

U.S. Pat. No. 5,709,043 describes a nose/adaptor combination wherein the adaptor socket tapers convergently towards a box-like front portion having upper and lower bearing surfaces generally parallel to a longitudinal axis of the tooth, a front transverse upright bearing surface and rearwardly divergent bearing surfaces formed at obtuse angles between the converging upper and lower walls and the side walls of the socket, ostensibly to avoid areas of stress concentration.

U.S. Pat. No. 6,018,896 describes a pin/retainer system for locking an excavation tooth onto an adaptor wherein the retainer is inserted in the adaptor and a wedge-shaped pin is driven into aligned apertures in the tooth and adaptor to resiliently engage with the retainer.

United States Publication No US 2002/0000053A1 describes a mechanism for releasably retaining an adaptor into the nose of a bucket lip or the like wherein a tapered threaded socket is non-rotatably located on the inside of an aperture in the side wall of the adaptor. A threaded retaining pin extends through the threaded socket and locates in an aligned aperture in the bucket nose.

U.S. Pat. No. 5,337,495 describes a tooth assembly with a two-piece telescopically engageable adaptor secured to a nose with a tapered wedge pin assembly. A similar mounting system is described in U.S. Pat. No. 5,172,501 and U.S. Pat. No. 6,052,927. Other retention systems for digging points on adaptors or adaptors on noses are described in U.S. Pat. Nos. 6,119,378, 6,467,204, and 6,467,203.

Other devices for removably securing replaceable wear elements on earth working equipment such as a retaining pin, a bolt, a pin lock and locking blocks engageable in a top aperture in a wear member are described in U.S. Pat. Nos. 3,839,805, 3,982,339, 4,587,751, 5,088,214 and 5,653,048 respectively.

U.S. Pat. No. 5,937,550 describes a lock assembly for releasably securing an adaptor to a nose of an excavator support structure. The lock assembly comprises a body and a base coupled together and adapted for insertion, while coupled together, in a hole in the nose of the support structure. The length of the lock assembly is extended to secure the adaptor and is retracted to release the adaptor. While adequate for securing an adaptor to a nose of an excavator support structure, the lock described in this patent is relatively complex in design and operation leading to high costs and labour intensive extraction procedures in the field.

Canadian Patent Application No 2,161,505 describes a system for removably retaining an excavation point on an adaptor with at least one flanged sleeve having a screw-threaded aperture therein, the flanged sleeve being non-rotatably locatable in a transverse bore in the adaptor before fitment of the point onto the adaptor. A screw-threaded pin is inserted into the sleeve via an aperture in the point whereby portion of the head of the pin retains the point on the adaptor.

Australian Patent Application No 2003264586 describes a locking pin assembly comprising a body member having a non-circular cross-sectional shape locatable in a bore of complementary shape extending laterally between opposite sides of an excavator lip mounting nose. After locating the body member in the nose aperture, an adaptor can be engaged over the nose with apertures in opposite side walls aligned with the body member. Threaded bolts engage in threaded apertures in opposite ends of the body member, the bolts each having a tapered shank portion with an enlarged boss at a free end thereof, the boss being locatable in a respective aperture in a side wall of said adaptor to prevent the adaptor from disengaging with the nose.

While generally satisfactory for their intended purpose, the abovementioned prior art all suffer from one or more shortcomings or disadvantages in terms of inadequate resistance to rotation of a tooth off a nose or an adaptor under the influence of vertical loads applying a rotational moment to the tooth, a predisposition to premature wear, difficulties in retention of the teeth on noses or adaptors, inadequate locking systems and unduly complicated configurations giving rise to increased fabrication costs. Furthermore, the prior art all generally rely on lock assemblies that require threaded components. Thread components in lock assemblies are generally disadvantageous as dirt and fines can infiltrate the threaded assembly thereby causing cementation and resulting in difficulties in removal.

OBJECT OF THE INVENTION

It is an object of the invention to overcome or at least alleviate one or more of the above problems and/or provide the consumer with a useful or commercial choice.

DISCLOSURE OF THE INVENTION

In one form, although it need not be the only or indeed the broadest form, the invention resides in a lock assembly for an excavator wear assembly, the lock assembly comprising:

a locking pin having a flange portion and a longitudinal axis; and a retaining assembly having a locking member, the retaining assembly being adapted to receive the locking pin;

wherein the locking member of the retaining assembly is adapted to deform perpendicular to the longitudinal axis of the locking pin as the locking pin is inserted longitudinally into the retaining assembly; and wherein the locking member of the retaining assembly is adapted to engage with the flange portion of the locking pin to prevent withdrawal of the locking pin from the retaining assembly when the locking assembly is in a locked position.

The locking member preferably has two side walls, an inner wall, and an outer wall. Preferably the side walls are parallel to each other and the outer wall is perpendicular to the side walls. Preferably the inner wall has at least a portion which is not parallel to the longitudinal axis of the locking pin when the locking pin is being received by the retaining assembly. In a preferred form, at least a portion of the inner wall is chamfered relative to the side walls. The chamfered portion preferably extends substantially between the side walls. The word chamfered preferably includes various inclinations, and is not intended to be limited to approximately 45°.

Preferably the locking member is a resilient locking ring. Preferably the resilient locking ring is adapted to expand radially around a portion of the locking pin. The locking ring is preferably substantially annular with an opening that allows, or at least facilitates, radial expansion. The locking ring is preferably partially annular with an opening which has a circumferential extent that is preferably less than 60°, or even more preferably less than 45°. In a preferred form, the locking ring is a partially annular member extending circumferentially approximately 330° to 340° with a respective 30° to 20° opening.

According to a form of the invention, the locking ring has a tab. The tab may be in the form of a flattened portion that is preferably in the form of a segment of the locking ring. The tab preferably corresponds to the flange portion of the locking pin. The tab is preferably located across the inner wall of the locking ring. Preferably the inner wall of the locking ring is chamfered except for the tab. The tab is preferably located approximately 90° from the opening. The tab preferably increases the radial width of the locking ring.

The flange portion of the locking pin is preferably formed by a groove in the locking pin. In a form the groove extends circumferentially around the locking pin and defines two flanged portions on either side of the groove. In another form the groove extends only partially around the circumference of the locking pin. In this form, the groove preferably has a flat bottom surface. Opposed walls of the groove, which are preferably perpendicular to the longitudinal axis of the locking pin, are preferably perpendicular relative to the flat bottom surface.

Preferably the locking pin has a tapered portion adjacent the groove. Preferably the tapered portion is formed by a progressive increase in diameter from a main body portion of the locking pin to adjacent the flange portion.

Preferably the retaining assembly further comprises a resilient spacer located adjacent the locking member. Preferably the resilient spacer receives the locking ring therein. The resilient spacer is preferably compressible.

In a form, the resilient spacer is a circular o-ring. In another form, the resilient spacer is a partially annular o-ring with an opening. Where the resilient spacer is partially annular, the opening of the resilient spacer is preferably substantially the same size as the opening of the locking ring. Preferably the o-ring has an inner diameter that is substantially the same as an outer diameter of the locking ring. Preferably, the resilient space is concentric with the locking member.

Preferably the retaining assembly further comprises a retaining member and a retaining washer. The retaining washer preferably has a tapered inner surface to facilitate location of the locking pin therethrough.

Preferably the retaining member receives the locking member and resilient spacer, more preferably the locking ring and o-ring, respectively. Preferably, a detent extends outwardly from a body of the retaining member. The detent preferably prevents rotation of the retaining member in use. Preferably the retaining member has a first seat that receives the locking ring and o-ring. Preferably the retaining member has a second seat that receives the washer. Preferably the second seat is adjacent the first seat such that the washer abuts the locking ring and o-ring.

The first seat of the retaining member preferably has a boss. The boss is preferably sized similarly to the size of the opening of the locking ring and o-ring. Preferably the boss is adapted to be received by an opening in the locking ring and, preferably, an opening in the resilient spacer. The boss preferably locates the locking ring in a fixed orientation. Preferably the boss locates the tab of the locking ring in a predetermined location with respect to the retaining member.

The first seat is preferably closer to the longitudinal axis of the locking pin than the second seat in the locked position. Preferably the seats are substantially annular with the first seat having a smaller diameter than the second seat. Preferably the retaining member has an aperture therethrough that receives the locking pin in use. Preferably, the aperture is defined by an inner circumferential side wall of the retaining member, the inner circumferential side wall extending between a top surface and a bottom surface of the retaining member. Preferably the aperture of the retaining member has a tapered portion that corresponds to the tapered portion of the locking pin.

Preferably the locking pin has a head portion. The head portion preferably has a diameter generally greater than the diameter of a main body portion of the locking pin. Preferably the head of the locking pin has a recess therein. Preferably the recess is shaped to receive and permit a tool to provide torque to the locking pin. The recess may also be shaped to receive and permit a tool to provide a prying force to the locking pin. The recess of the locking pin may have a trough for receiving a pry tool.

The head of the locking pin may additionally, or alternatively, have a pry rope. The pry rope is preferably formed by a wire loop affixed to the head of the locking pin. The wire loop may be affixed to the head of the locking pin by rope locking members, preferably screws, received therein. The pry rope may be contained under a cap secured to the head of the locking pin.

The head of the locking pin preferably has at least one shaped portion, preferably a circumferential ramp, which engages with portions of the wear assembly to provide a force longitudinal to the locking pin when the locking pin is rotated. Preferably the head of the locking pin has at least one protrusion. Preferably the head of the locking pin has two protrusions. Preferably the protrusions engage with ramps of the wear assembly. The protrusions may be ramps that correspond to the ramps of the wear member.

In a further form, the invention resides in a lock assembly for an excavator wear assembly, the lock assembly comprising:

a locking pin having a flange portion and a longitudinal axis, wherein at least a portion of the flange portion is substantially perpendicular to the longitudinal axis; and a retaining assembly having a locking member with a tab, the retaining assembly being adapted to receive the locking pin;

wherein the locking member of the retaining assembly is adapted to deform perpendicular to the longitudinal axis of the locking pin as the locking pin is inserted longitudinally into the retaining assembly; and wherein the tab of the locking member is adapted to engage with the flange portion of the locking pin to prevent withdrawal of the locking pin from the retaining assembly when the lock assembly is in a locked position.

In a further form, the invention resides in an excavator wear member for use with a lock assembly as hereinbefore described.

In a further form, the invention resides in an excavator wear member comprising:

a locking aperture extending through a side wall of the excavator wear member, the locking aperture having a receiving passage and a retaining recess; wherein, the receiving passage extends inwardly from an outer face of the side wall and the retaining recess is located in an inner face of the side wall such that the receiving passage terminates at the retaining recess; and a retaining assembly located within the retaining recess, the retaining assembly having a locking member;

wherein the locking aperture and retaining assembly located in the retaining recess are adapted to receive a locking pin, the locking member being adapted to deform perpendicular to the longitudinal axis of the locking pin as the locking pin is inserted longitudinally into the retaining assembly; and wherein the locking member is adapted to engage with a flange portion of the locking pin to prevent withdrawal of the locking pin when the locking pin is in a locked position.

Preferably the locking member is a locking ring and preferably the locking ring is adapted to expand radially around a portion of the pin.

The retaining assembly preferably further comprises a spacer, preferably an o-ring, and a washer. The retaining assembly may also further comprise a retaining member received in the retaining recess. The retaining member preferably has a first seat that receives the locking ring and o-ring and a second seat that receives the washer. The retaining member may be secured in the retaining recess of the wear member. Alternatively, the retaining recess may have a retaining portion that retains the locking ring.

In a further form, the invention resides in an excavator wear member comprising:

a locking aperture extending through a side wall of the excavator wear member, the locking aperture extending inwardly from an outer face of the side wall; and a retaining assembly having a locking member located within the locking aperture;

wherein the locking aperture and retaining assembly located in the locking aperture are adapted to receive a locking pin, with the locking member being adapted to deform perpendicular to the longitudinal axis of the locking pin as the locking pin is inserted longitudinally into the retaining assembly and to engage with a flange portion of the locking pin to prevent withdrawal of the locking pin from the locking aperture when the locking pin is in a locked position.

The locking member is preferably a resilient locking ring. Preferably the locking ring expands radially around a portion of the locking pin. The retaining assembly preferably further comprises a resilient o-ring. The o-ring is preferably located concentrically with the locking ring.

In a further form, the invention resides in an excavator wear assembly comprising:

an excavator wear member having a socket cavity and locking aperture extending through a side wall of the excavator wear member, the locking aperture having a receiving passage and a retaining recess;

a retaining assembly located within the retaining recess, the retaining assembly having a locking member; and an adaptor having a spigot portion located within the socket cavity of the excavator wear member and a retaining passage;

wherein a locking pin is adapted to be located through the locking aperture of the excavator wear member and the retaining passage of the adaptor and wherein the locking member is adapted to deform perpendicularly to a longitudinal axis of the locking pin as the locking pin is inserted longitudinally into the retaining assembly and to engage with a flange portion of the locking pin to prevent withdrawal of the locking pin when the locking pin is in a locked position.

Preferably the locking member is a lock ring. Preferably the locking ring expands radially around a portion of the pin.

In a further form, the invention resides in a method of securing an excavator wear member to an adaptor having a spigot portion, the method comprising the steps of:

fitting the excavator wear member onto the spigot portion of the adapter;

inserting a locking pin through a locking aperture of the excavator wear member, an aperture of a retaining assembly located within a retaining recess of the excavator wear member, and a retaining passage of the adapter; and applying force to the locking pin longitudinally to force a locking member of the retaining assembly to deform perpendicularly to a longitudinal axis of the locking pin as the locking pin is inserted longitudinally and engage with a flange portion of the locking pin to thereby retain the locking pin in a locked position.

Preferably the locking member is a locking ring and the step of applying force to the locking pin longitudinally forces the locking ring to expand radially around a tapered portion of the locking pin and engage with the flange portion of the locking pin.

Preferably the flange portion of the locking pin is a substantially rectangular groove. Preferably the locking member is a locking ring and the tab is a flattened portion of the locking ring.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

The excavator wear assembly and lock assembly are described with reference to an excavator wear member in the form of a tooth releasably secured to an adaptor. The adaptor is in turn secured to a nose of an excavator bucket or the like. A skilled addressee will appreciate that the invention may be employed to releasably secure an adaptor to a nose or a tooth directly to a nose of an excavator bucket lip and the like.

Furthermore, the lock assembly may be utilised in other applications such as a retaining pin for components in dragline excavator rigging and the like.

Figure 1A:
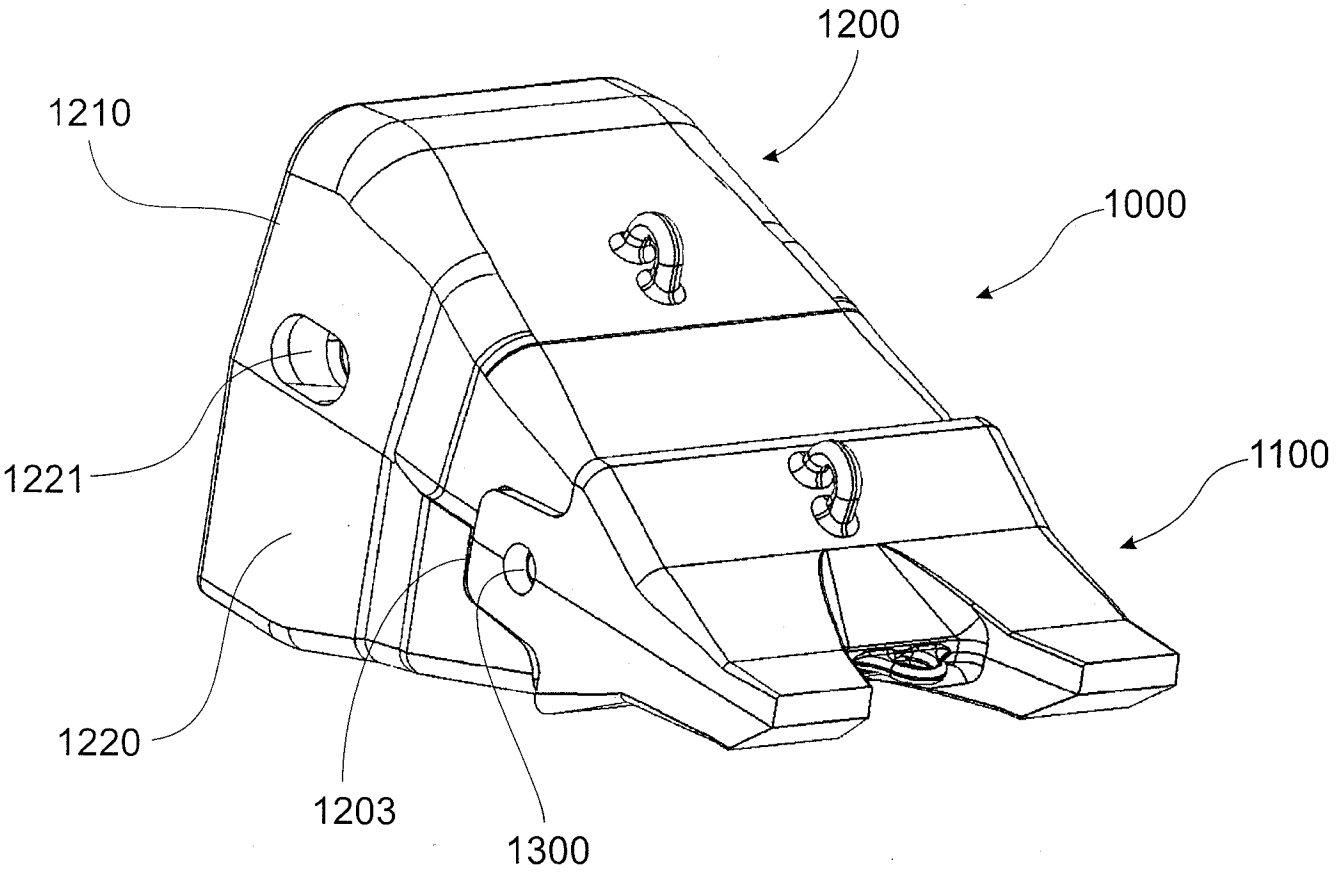
FIG. 1A shows a perspective view of an excavator wear assembly according to an embodiment of the invention.
Figure 1B:
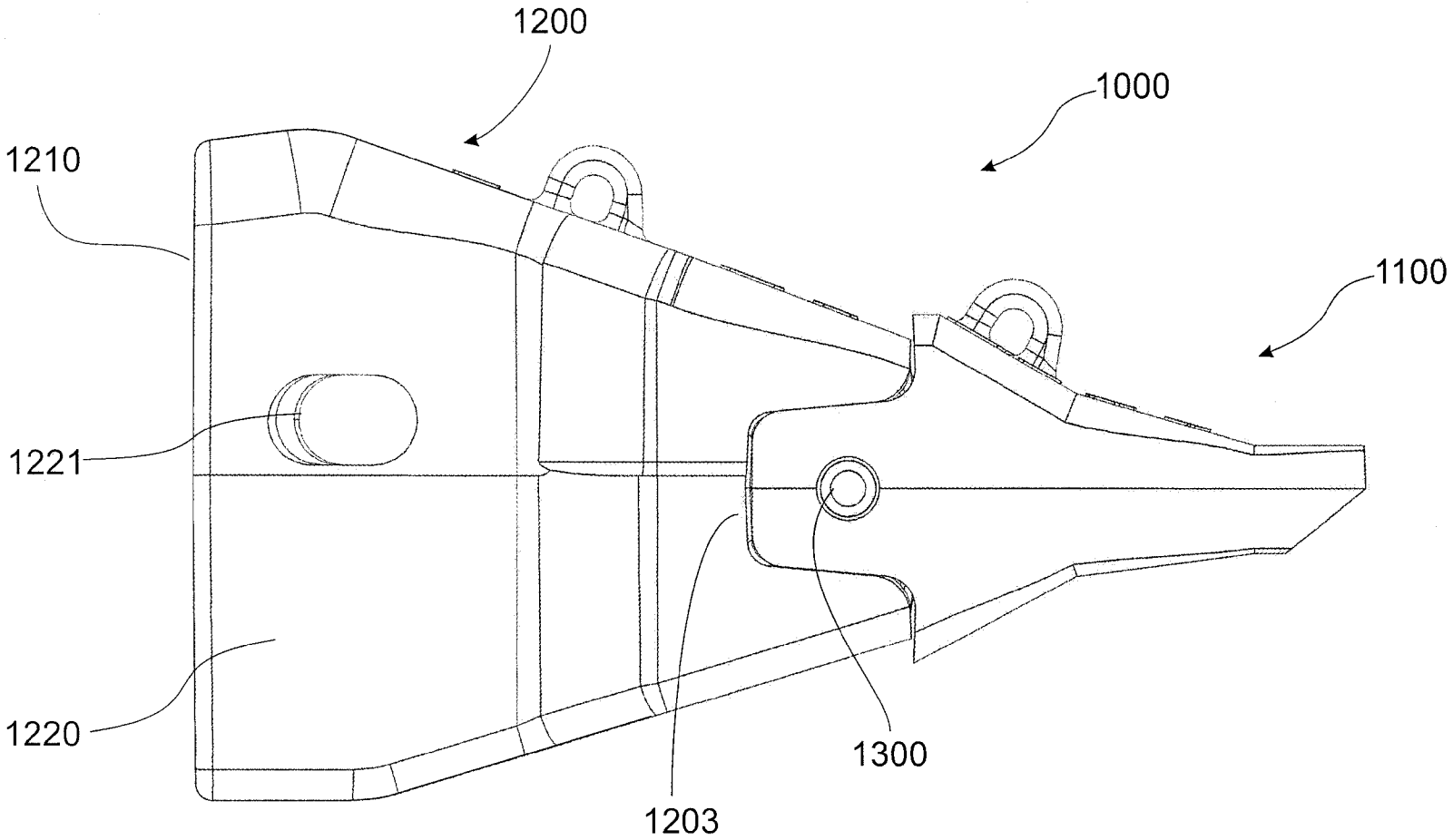
FIG. 1B shows a side elevation view of the excavator wear assembly shown in FIG. 1A.
Figure 1C:
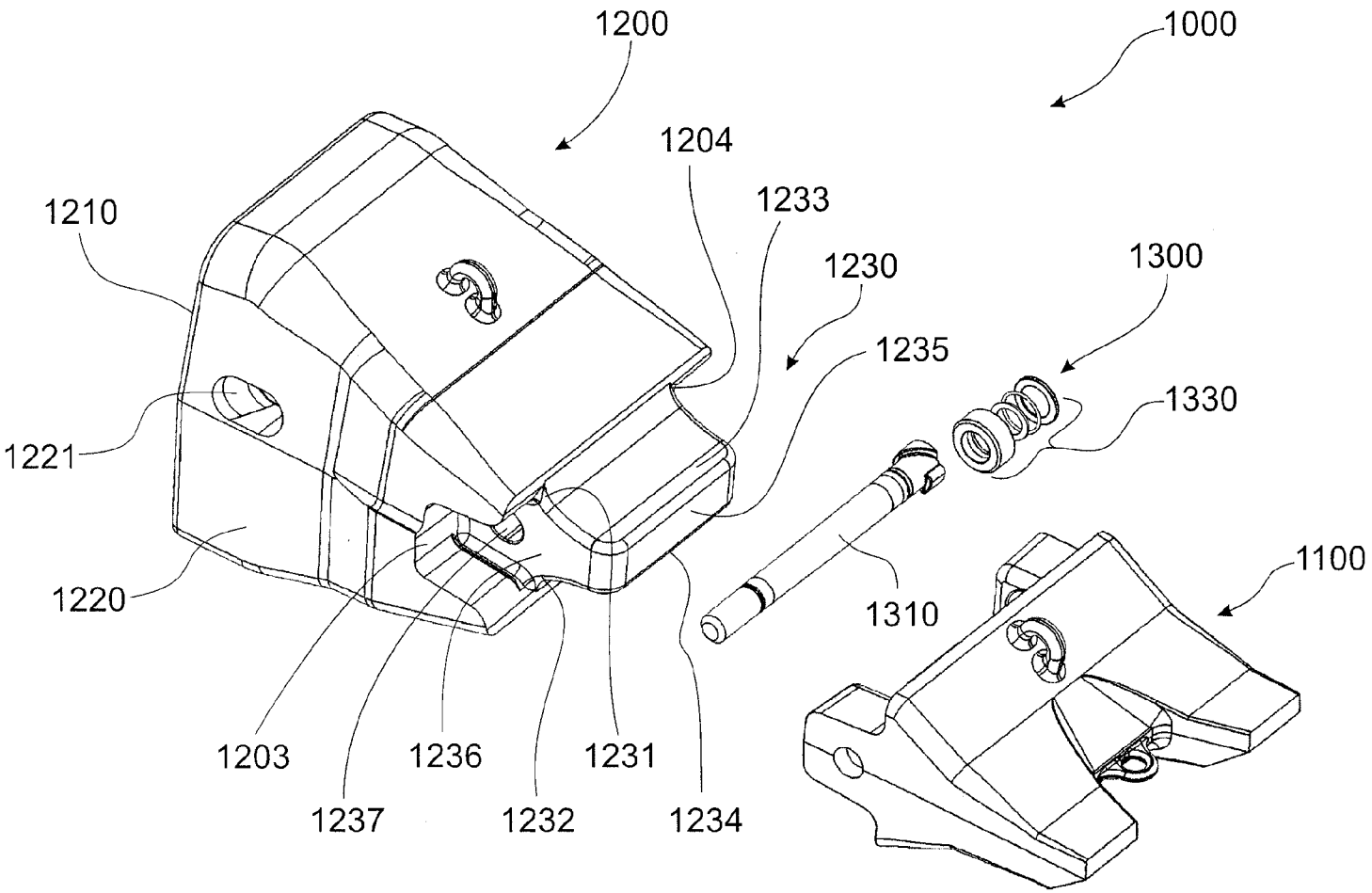
FIG. 1C shows an exploded perspective view of the excavator wear assembly shown in FIG. 1A.

FIG. 1A shows a perspective view of an excavator wear assembly 1000 according to an embodiment of the invention in the locked position. FIG. 1B shows a side elevation view of the excavator wear assembly 1000. FIG. 1C shows an exploded perspective view of the excavator wear assembly 1000 which is effectively in an unlocked position. Excavator wear assembly 1000 comprises a wear member in the form of a tooth 1100 mountable on an adaptor 1200 and a lock assembly 1300 adapted to releasably secure tooth 1100 on adaptor 1200 as will be discussed in greater detail below.

Adaptor 1200 is suitably configured for mounting on a digging edge of an excavator by way of an adaptor socket 1210. Adaptor socket 1210 is formed in a shape complimentary with a nose of an excavator digging edge (not shown).

Adaptor 1200 has aligned transverse apertures 1221 each extending through a respective opposed side wall 1220. Aligned transverse apertures 1221 are adapted to receive an adaptor retaining pin (not shown) which extends through aligned transverse apertures 1221 and an adaptor retaining pin passage in the complimentary shaped nose (not shown) to thereby retain the adaptor 1200 on the excavator digging edge.

Additionally, adaptor 1200 has a pair of side wall mounting recesses 1203 and 1204 located in a forward portion of respective opposed side wall 1220.

Adaptor 1200 further includes a spigot portion 1230 extending from a forward portion thereof. Spigot portion 1230 has converging upper and lower rear bearing surfaces 1231, 1232 which terminate at substantially parallel upper and lower forward bearing surfaces 1233, 1234 respectively. A front bearing face 1235 is disposed between upper forward bearing surface 1233 and lower forward bearing surface 1234.

Spigot portion 1230 also has a retaining passage 1237 extending therethrough between opposed side walls 1236 thereof.

Figure 2A:
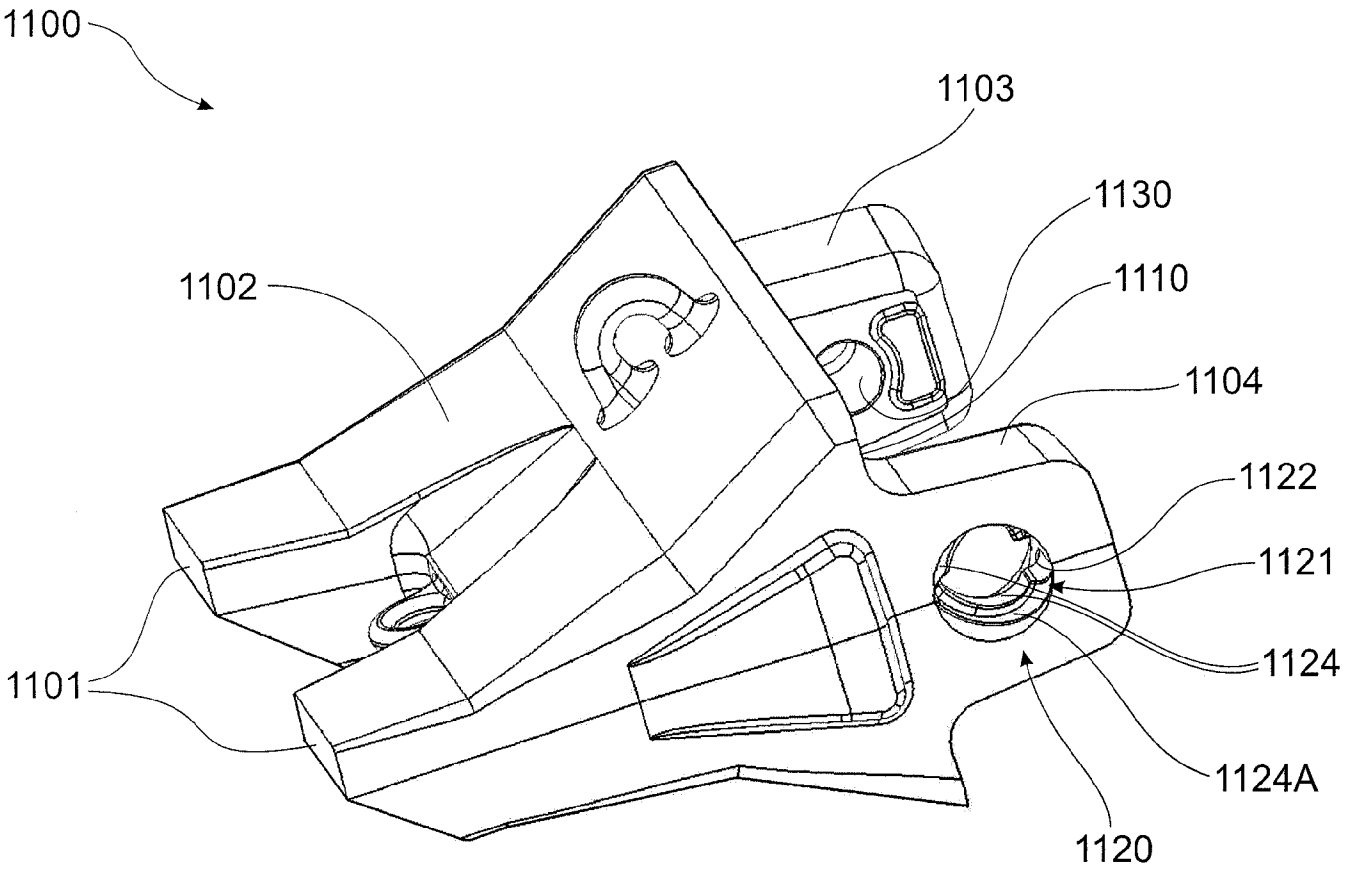
FIG. 2A shows a reverse perspective view of a tooth forming part of the excavator wear assembly shown in FIG. 1A.
Figure 2B:
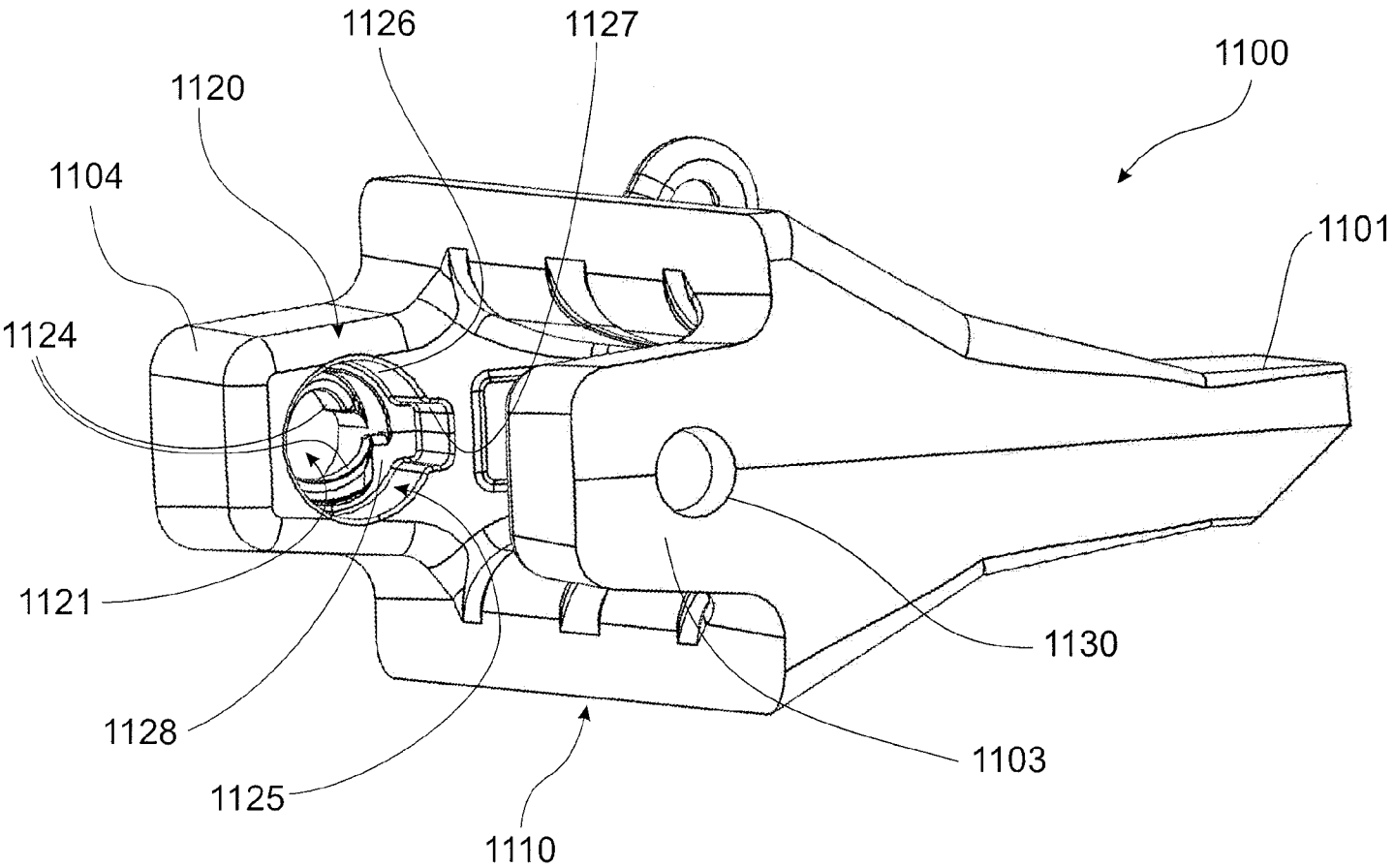
FIG. 2B shows a rear perspective view of a tooth forming part of the excavator wear assembly shown in FIG. 1A.
Figure 2C:
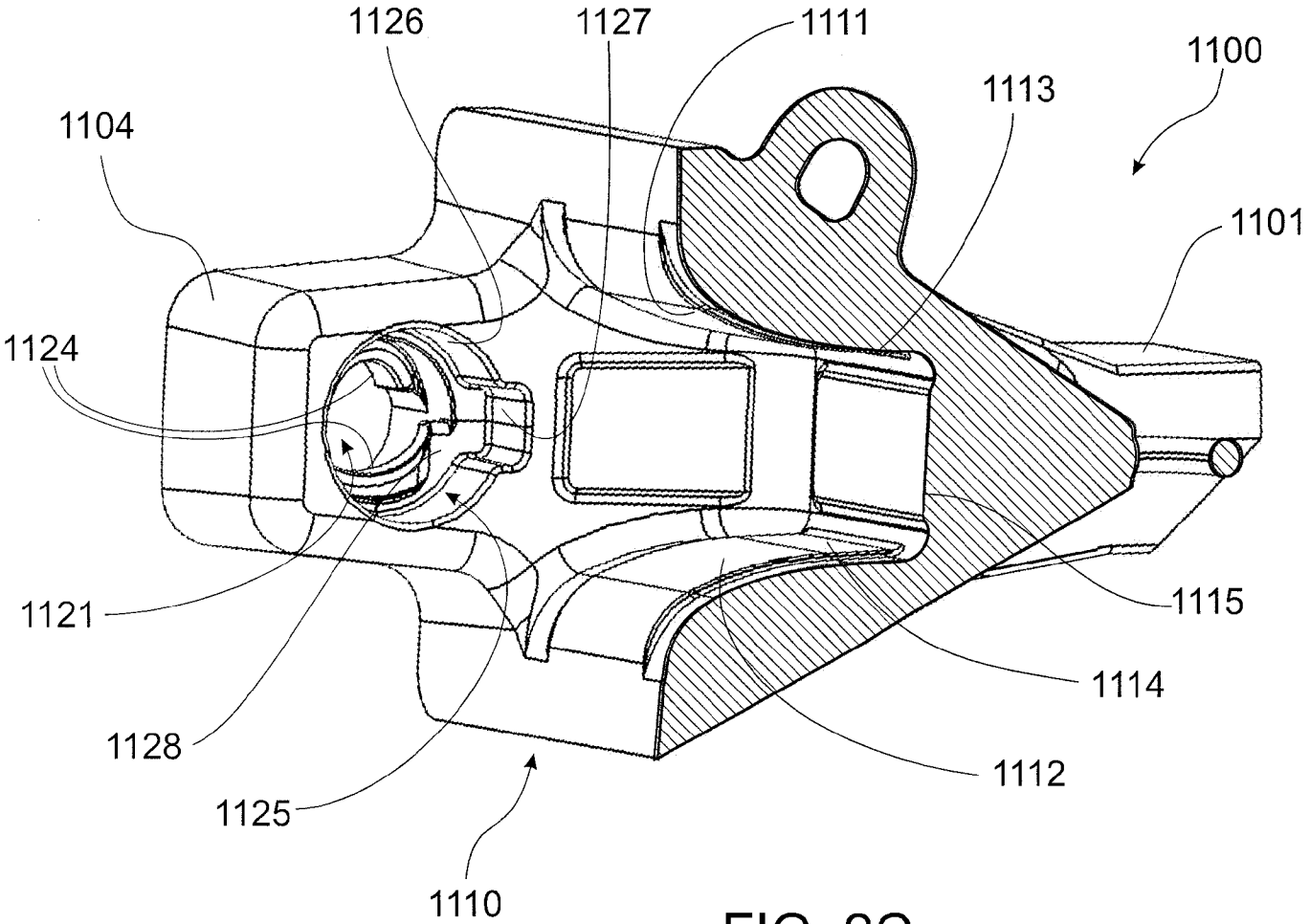
FIG. 2C shows a sectional perspective view of the tooth as shown in FIG. 2B.

FIG. 2A shows a reverse perspective view of wear member in the form of tooth 1100. FIG. 2B shows a rear perspective view of the tooth 1100 and FIG. 2C shows a sectional perspective view of the tooth 1100.

Tooth 1100 has a forwardly projecting working end 1101 and a socket cavity 1110 formed from converging upper and lower rear bearing surfaces 1111 and 1112 respectively. Each of upper and lower bearing surfaces 1111 and 1112 terminate at substantially parallel upper and lower forward bearing surfaces 1113 and 1114 respectively. A front bearing face 1115 is disposed between upper forward bearing surface 1113 and lower forward bearing surface 1114.

Bearing surfaces 1111, 1112, 1113, and 1114 and front bearing face 1115 of tooth socket 1110 are configured to be complimentary with bearing surfaces 1231, 1232, 1233 and 1234 and front bearing face 1235 respectively of spigot portion 1230 of adaptor 1200. Socket cavity 1110 is adapted to receive spigot portion 1230 of adaptor 1200.

Tooth 1100 further includes mounting ears 1103 and 1104 extending rearwardly of tooth body 1102 from opposed sides thereof. In use, mounting ears 1103 and 1104 are adapted to be located within mounting recesses 1203 and 1204 respectively of adaptor 1200.

Additionally, a toe aperture 1130 extends through mounting ear 1103 and a locking aperture 1120 extends through opposed mounting ear 1104 as shown. In use, toe aperture 1130 and locking aperture 1120 are adapted to at least partially align with retaining passage 1237 of adaptor 1200.

Toe aperture 1130 is generally circular in cross section and extends through mounting ear 1103 as shown. Toe aperture 1130 is generally smaller than locking aperture 1120.

Locking aperture 1120 extends through mounting ear 1104 and is formed from a receiving passage 1121 and a retaining recess 1125. Optionally, locking aperture 1120 may extend through any wall of the tooth 1100.

Receiving passage 1121 has a generally circular main portion 1122 and a pair of ramps 1124 extending about an inner face of receiving passage 1121 such that each ramp 1124 starts from diametrically opposite sides of receiving passage 1121 adjacent an outer end thereof and traverse a half circumferential path about inner face of receiving passage 1121 to terminate adjacent retaining recess 1125. Each ramp 1124 defines an outwardly facing insertion face 1124A.

Retaining recess 1125 has a generally circular main portion 1126 and an optional blind slot 1127 extending outwardly from circular main portion 1126. Circular main portion 1126 of retaining recess 1125 is concentric with circular main portion 1122 of receiving passage 1121 with circular main portion 1126 having a relatively larger diameter thereby forming a locking face 1128 at an inner end of retaining recess 1125.

Figure 3A:
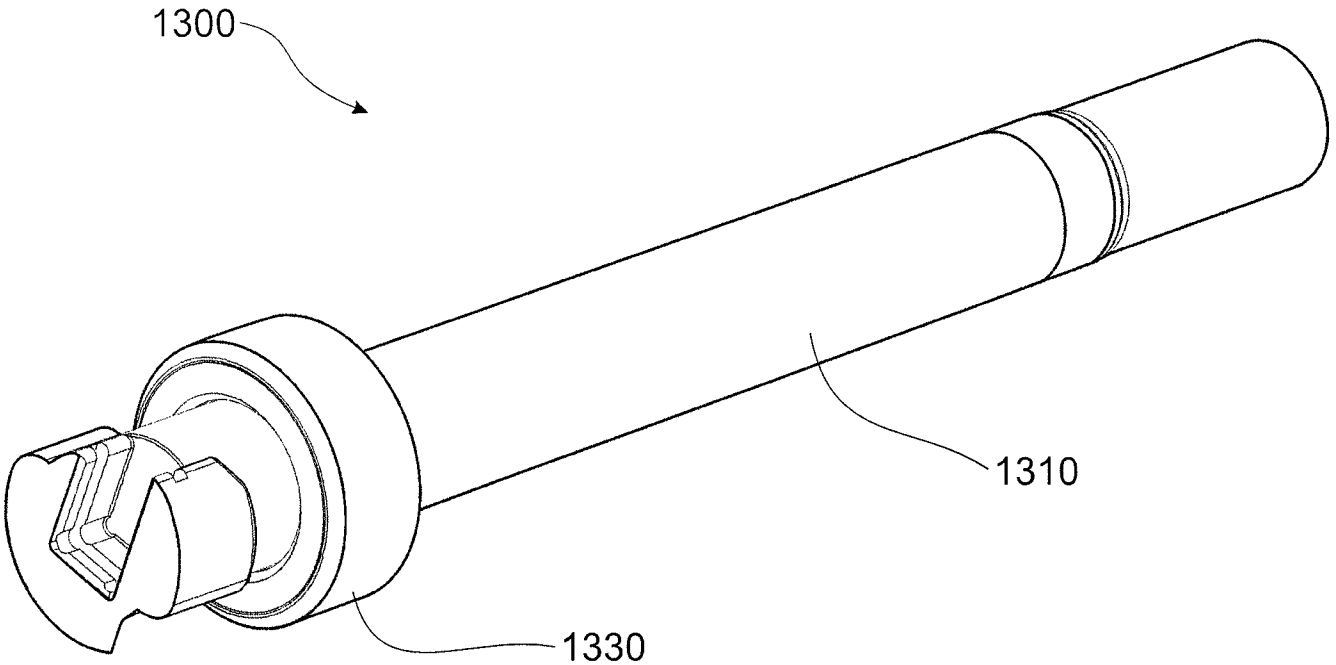
FIG. 3A shows a perspective view of a lock assembly as shown in FIG. 1A.
Figure 3B:
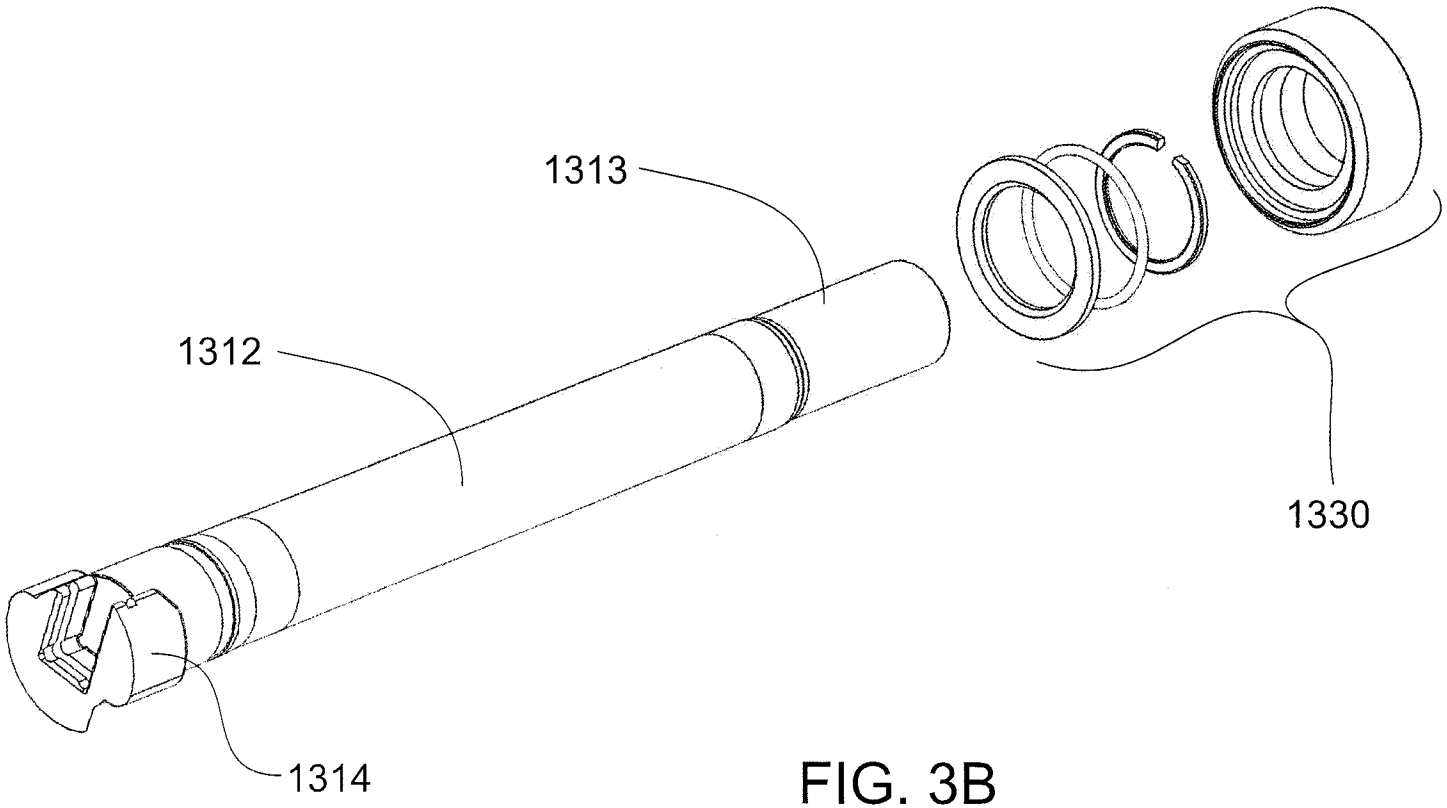
FIG. 3B shows an exploded perspective view of the lock assembly shown in FIG. 3A.

FIG. 3A shows a perspective view of lock assembly 1300 in a locked position and FIG. 3B shows an exploded perspective view of lock assembly 1300.

Lock assembly 1300, seen most clearly in FIG. 3B, comprises a locking pin 1310 and a retaining assembly 1330. Locking pin 1310 has a toe portion 1313 extending from an end of main portion 1312 distal a head portion 1314. Toe portion 1313 is adapted to be located in toe aperture 1130 of tooth 1100 as will be discussed in greater detail below.

Figure 4A:
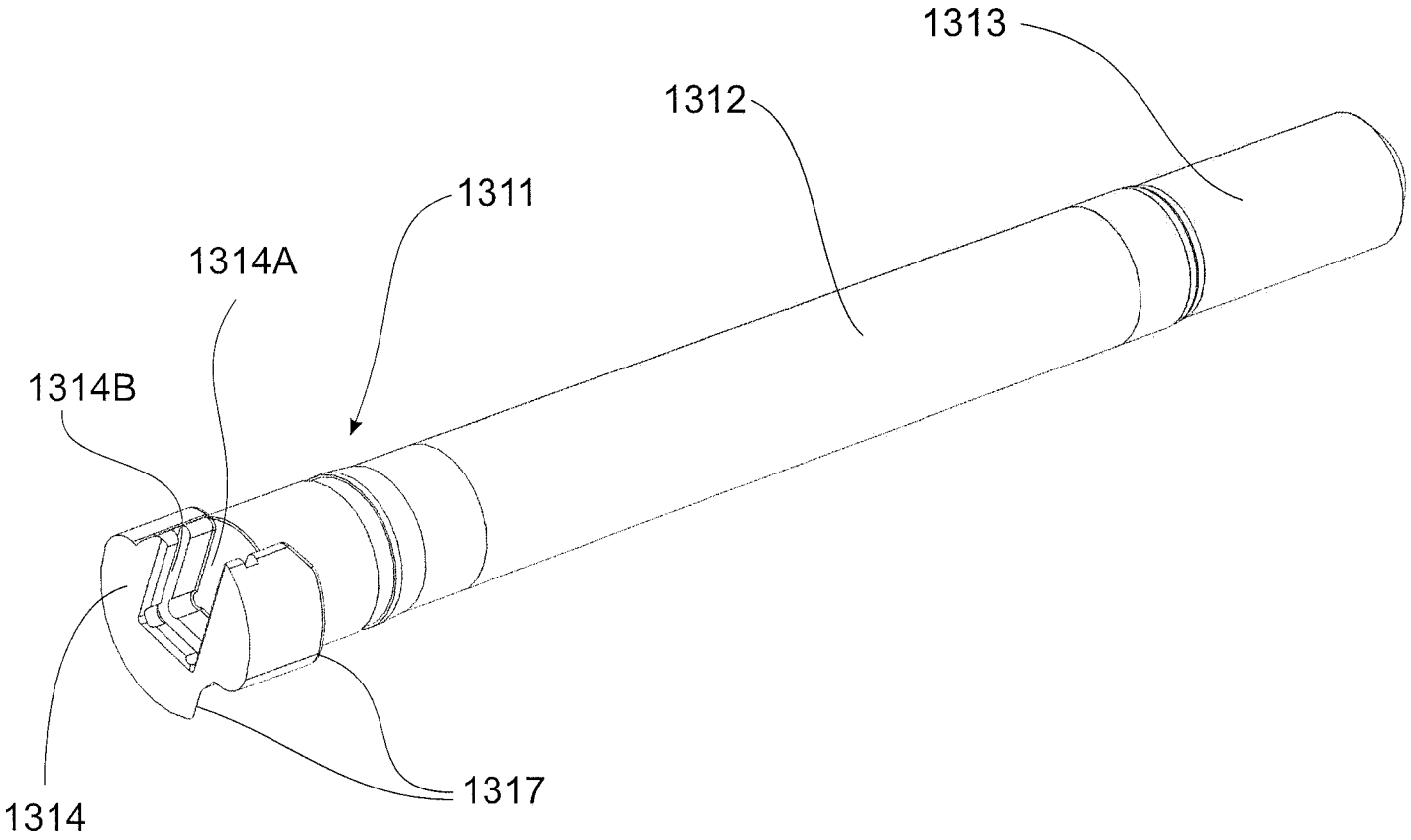
FIG. 4A shows a perspective view of a locking pin forming part of the lock assembly shown in FIG. 3A.
Figure 4B:
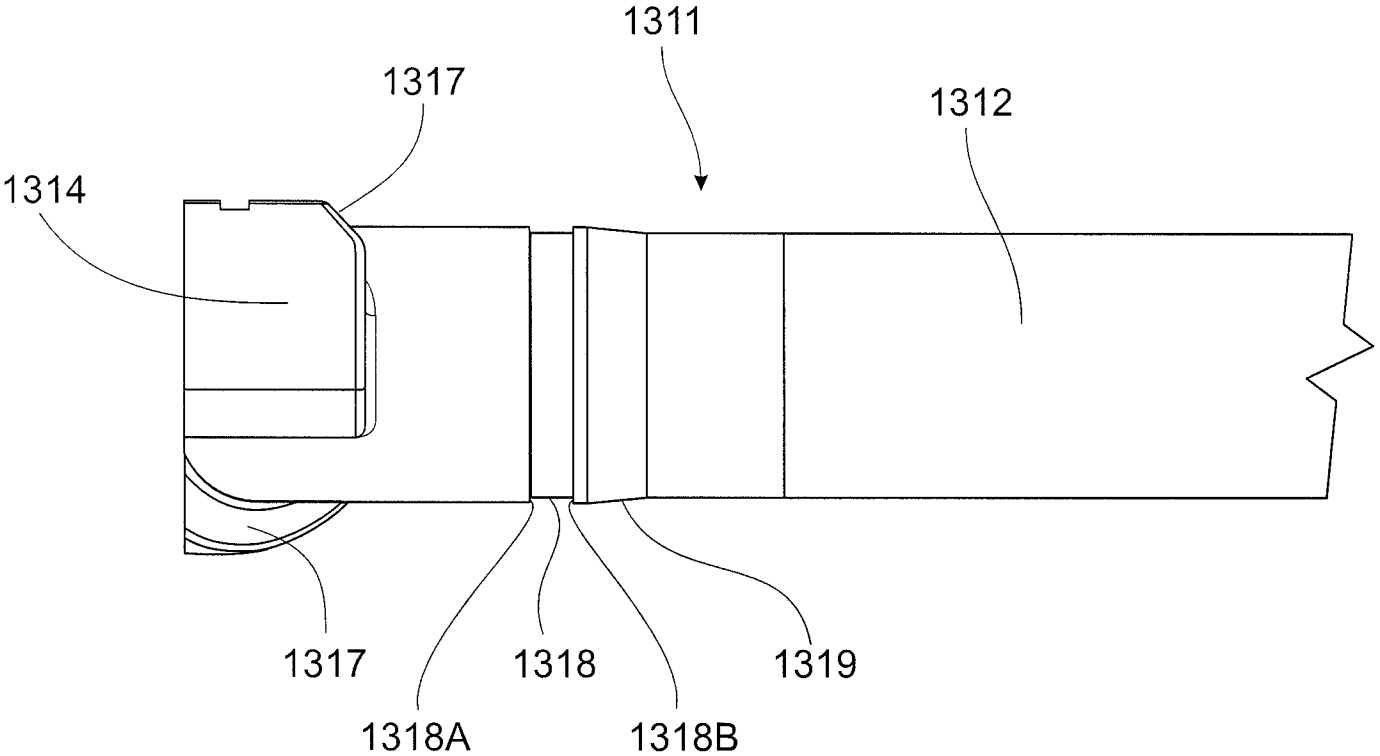
FIG. 4B shows a close-up side elevation view of the locking pin shown in FIG. 4A.
Figure 4C:
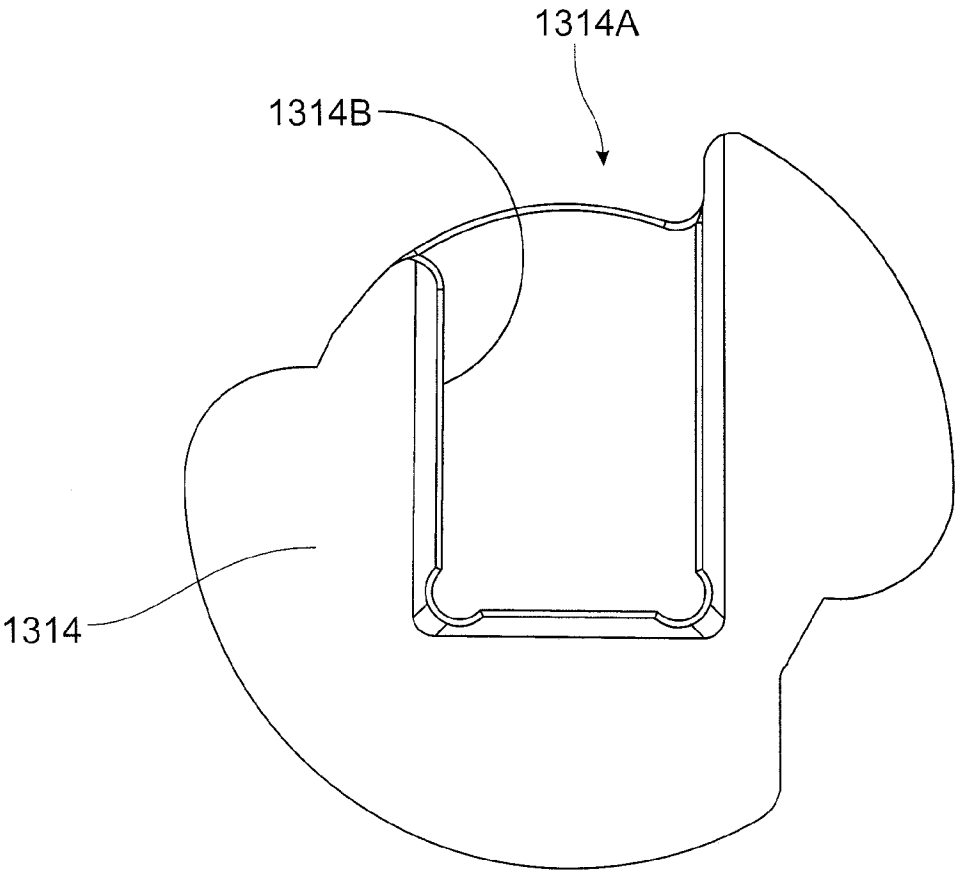
FIG. 4C shows an end elevation view of the locking pin shown in FIG. 4A.

FIGS. 4A, 4B, and 4C show locking pin 1310 in greater detail. Locking pin 1310 has a main portion 1312, toe portion 1313, and head 1314, with a flange portion 1311 between the main portion 1312 and head 1314. The main portion 1312 may optionally be tapered, narrowing toward toe portion 1313.

Head portion 1314 has a recess 1314A therein with a trough 1314B forming a slot that extends around the walls of the recess 1314A. The recess 1314A is open on one side which, together with the trough 1314B, can be used with pry tools as will be discussed further below. Head 1314 of locking pin 1310 also has shaped portions in the form of ramps 1317 that correspond with ramps 1124 of the wear member 1100. As shown in FIG. 4C, head portion 1314 is shaped and recess 1314A is generally rectangular, but other shapes would also be suitable including, for example, a generally hexagonal shaped recess. The head portion 1314 is shaped to correspond with a receiving portion of the locking aperture 1120.

Flanged portion 1311, seen most clearly in FIG. 4B, has a circumferential groove 1318 that defines side walls 1318A and 1318B. Adjacent side wall 1318B is a tapered portion 1319 that increases in diameter from the main portion 1312 of the pin 1310 to a greater diameter adjacent side wall 1318B.

Figure 5A:
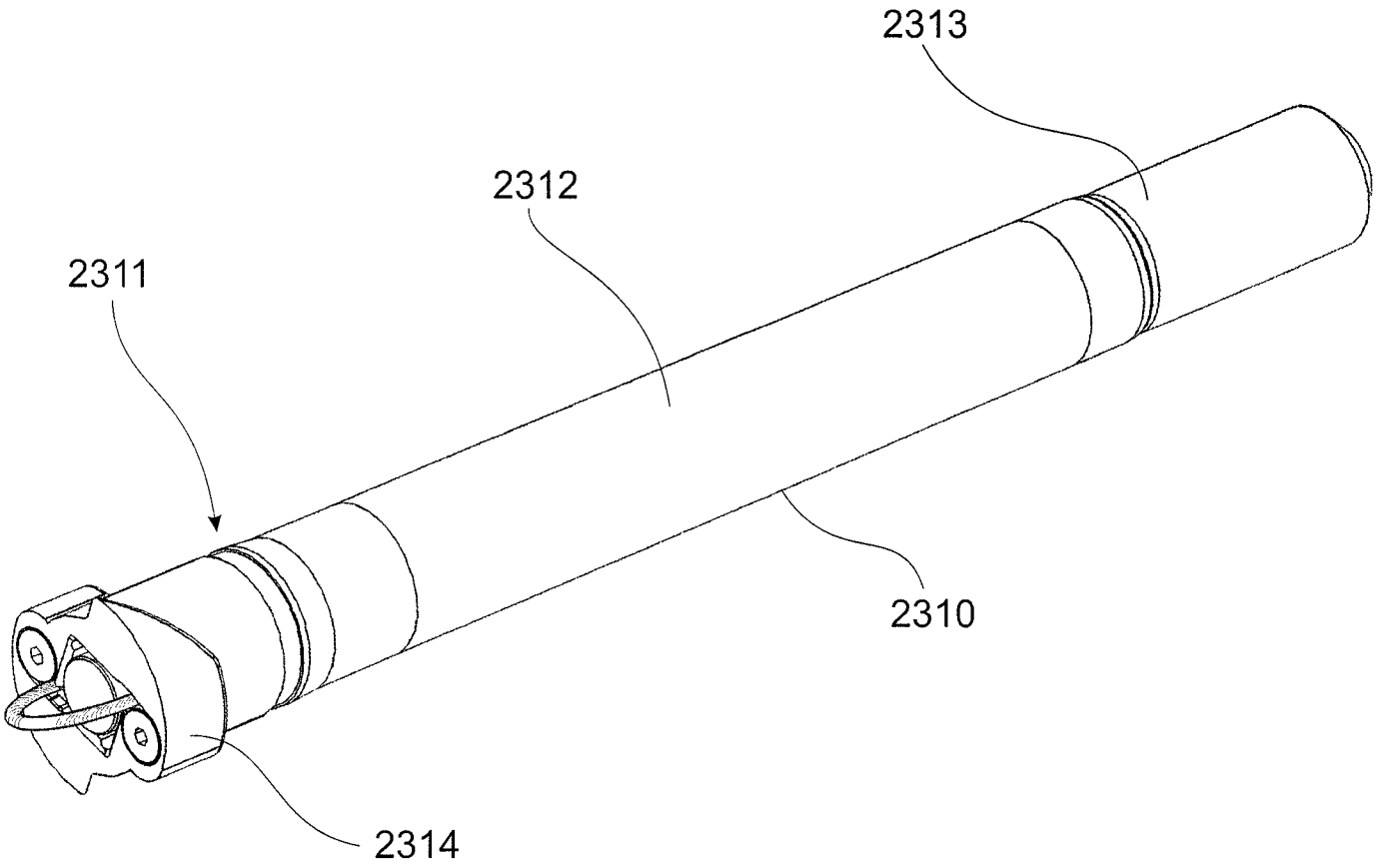
FIG. 5A shows a perspective view of an alternative locking pin to that that shown in FIGS. 4A to 4C.
Figure 5B:
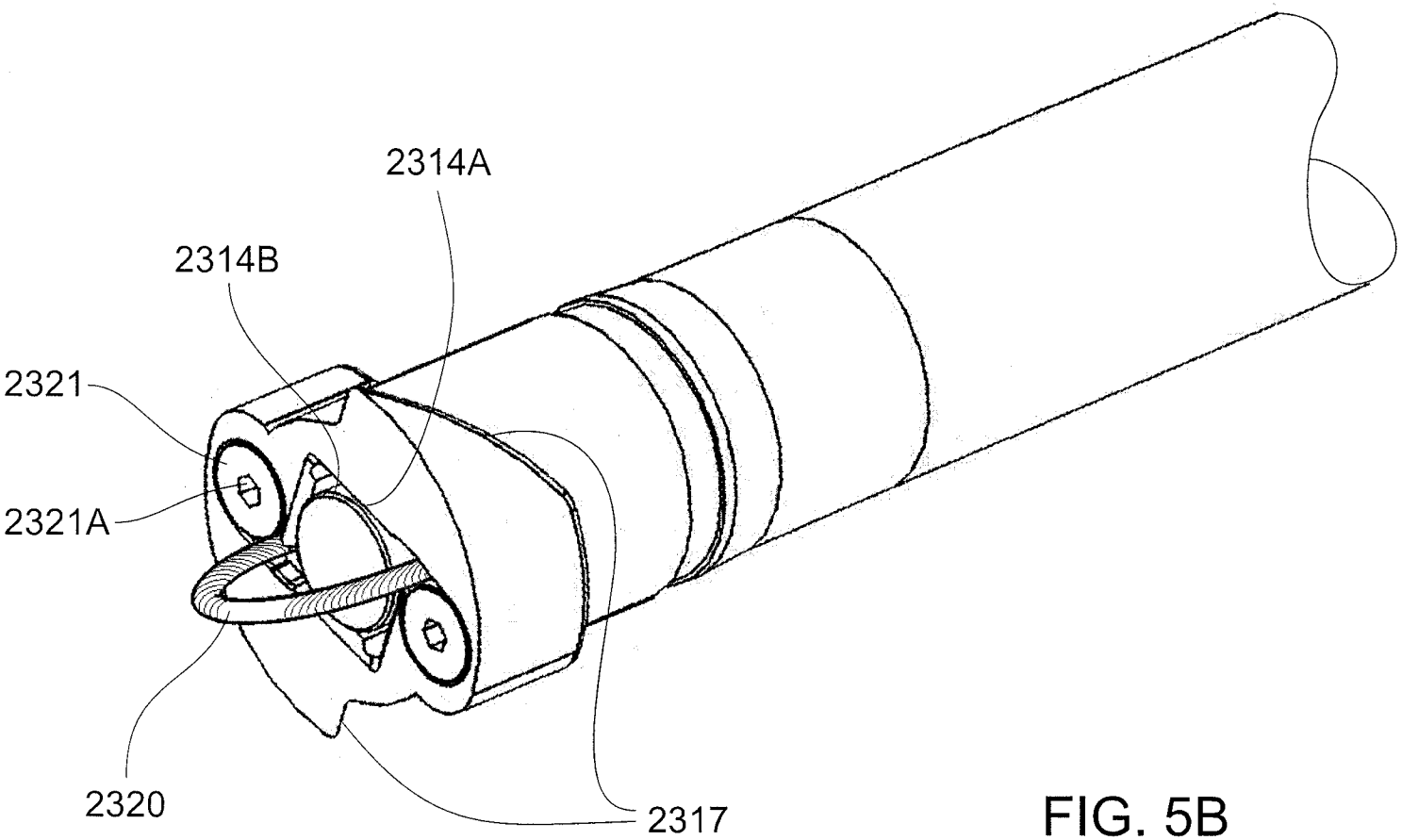
FIG. 5B shows a close-up perspective view of the locking pin shown in FIG. 5A.
Figure 5C:
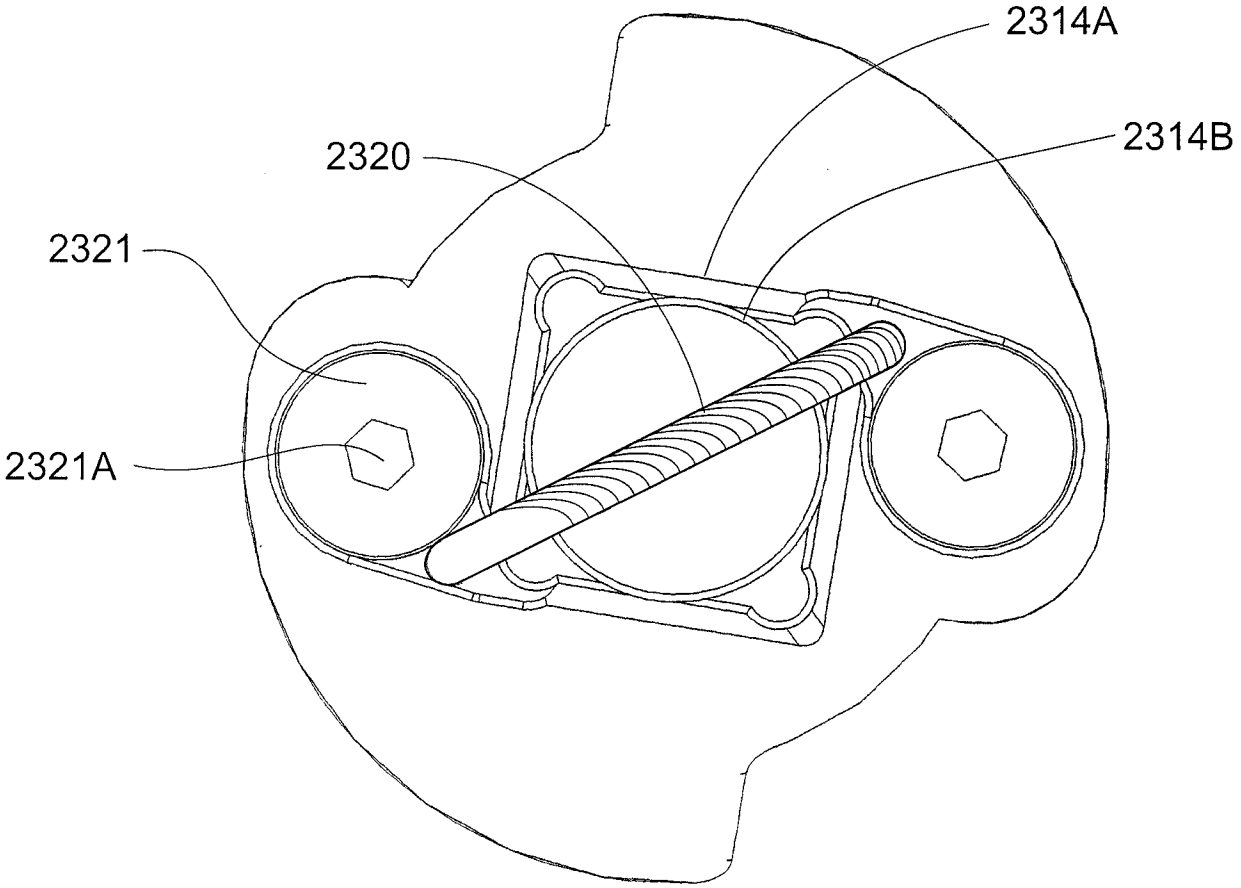
FIG. 5C shows an end elevation view of the locking pin shown in FIG. 5A.

FIGS. 5A, 5B, and 5C show an alternative locking pin 2310 having a similar main portion 2312, toe portion 2313, and flange portion 2311, but a distinctly different head portion 2314. Head portion 2314, shown in greatest detail in FIGS. 5B and 5C, has a recess 2314A with a plug in the form of a cap 2314B residing therein. Although the plug is only illustrated in relation to the alternative locking pin 2310, it will be appreciated that a plug could also be used in recess 1314A of locking pin 1310 of FIGS. 4A to 4C.

Head portion 2314 of alternative locking pin 2310 has shaped portions in the form of ramps 2317 and a pry rope in the form of a wire 2320 secured into the head portion 2314 of the locking pin 2310 by screws 2321 which can be rotated using a tool fitting 2321A. Wire 2320 may be secured by other means and may be configured under cap 2314B for protection.

Figure 6A:
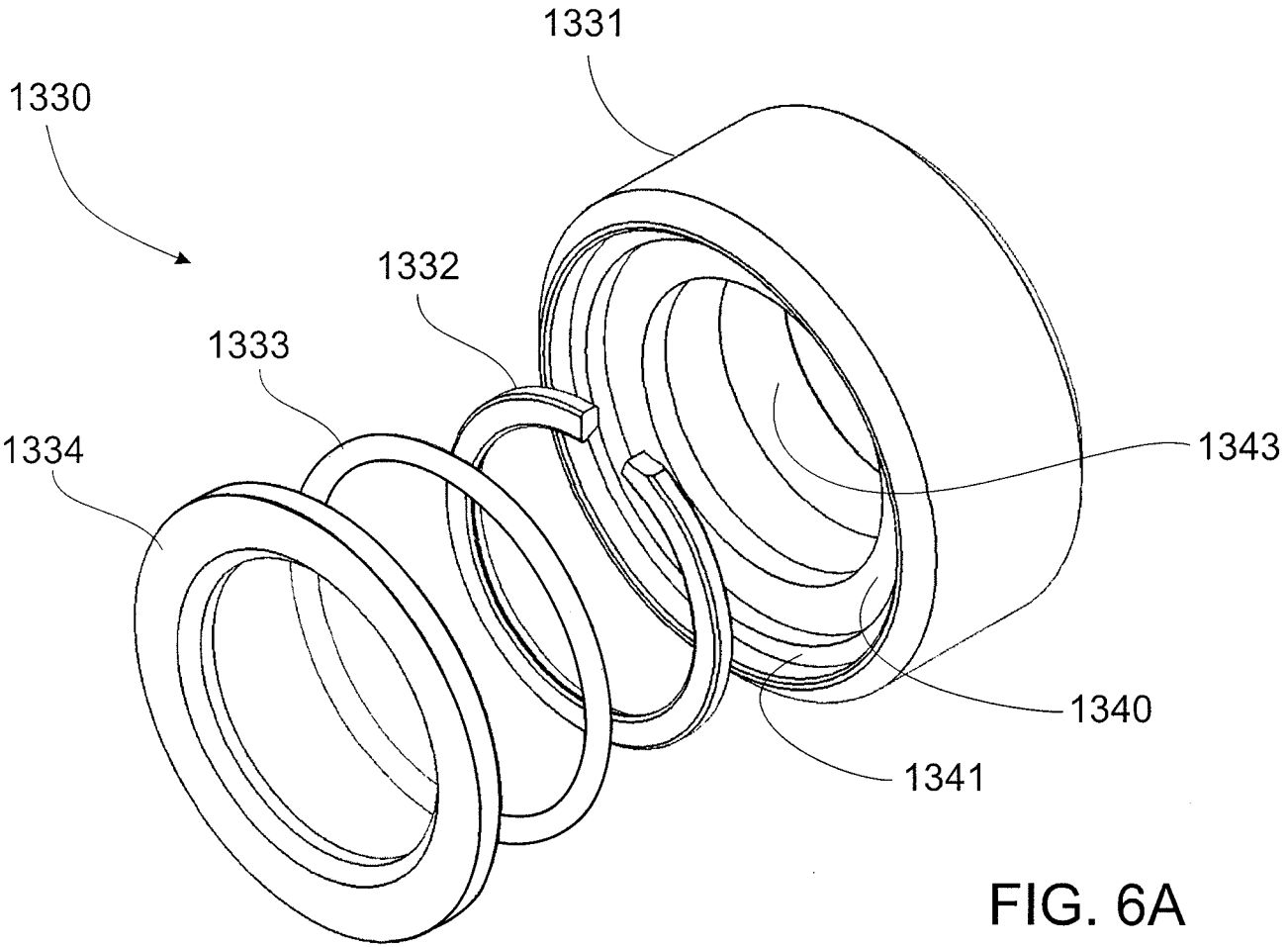
FIG. 6A shows an exploded perspective view of a retaining assembly forming part of the lock assembly shown in FIG. 3A.
Figure 6C:
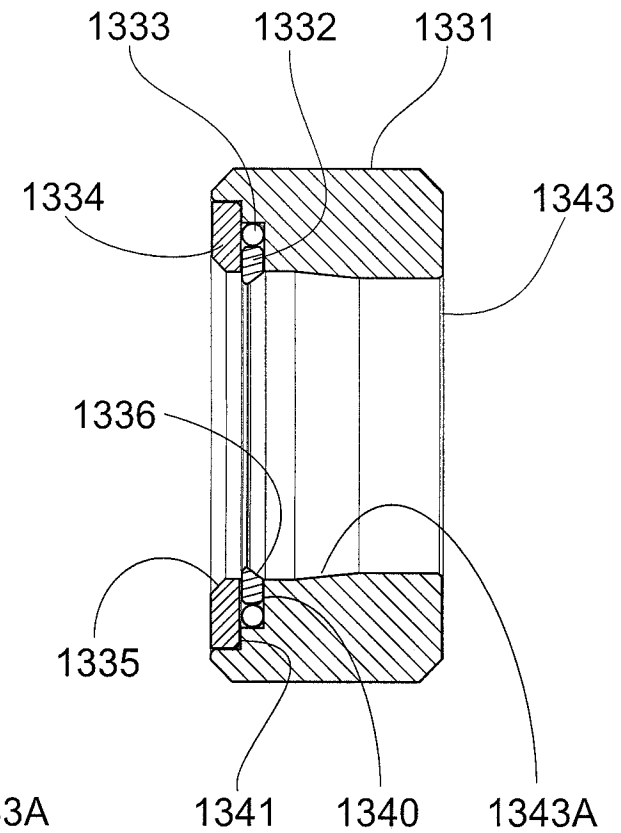
FIG. 6C shows a side cross-sectional view of the retaining assembly shown in FIG. 6A.
Figure 6B:
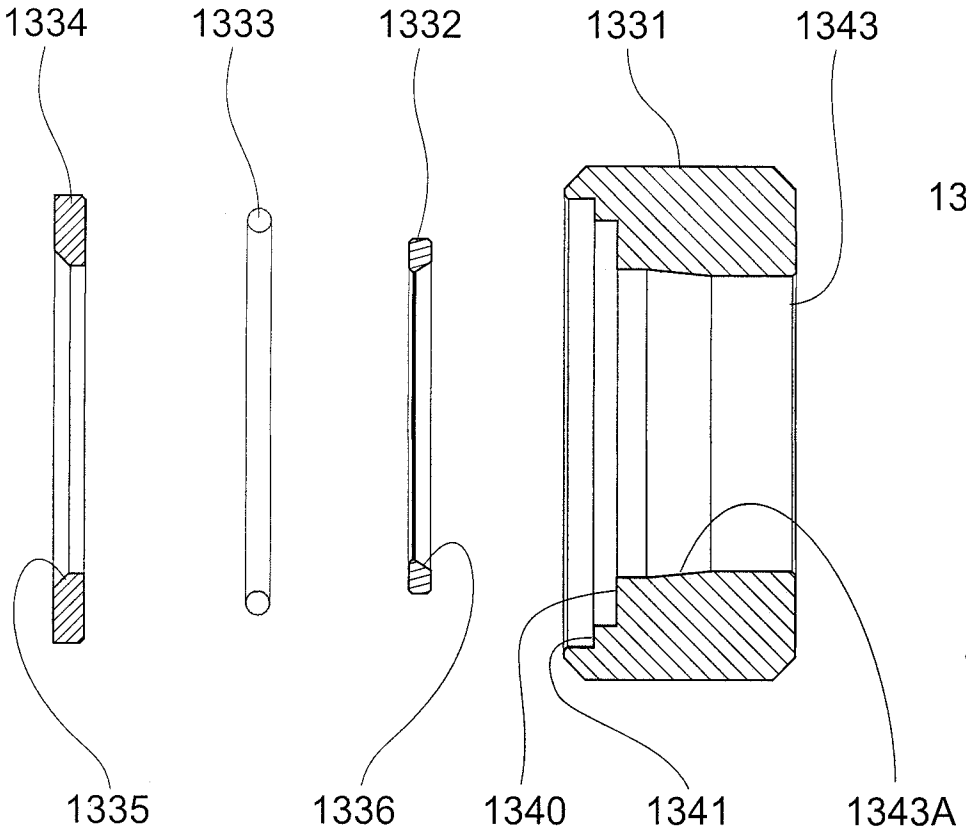
FIG. 6B shows an exploded side cross-sectional view of the retaining assembly shown in FIG. 6A.

Retaining assembly 1330 is shown in FIGS. 6A, 6B, and 6C. Retaining assembly has a retaining member 1331, a locking member in the form of a resilient locking ring 1332, a spacer in the form of a resilient o-ring 1333, and a washer 1334. Retaining member 1331 is generally cylindrical with an aperture 1343 therein. Retaining member 1331 has a first seat 1340 that receives the locking ring 1332 and o-ring 1333 and a second seat 1341 that receives the washer 1334 as shown in FIG. 6C. The aperture 1343 of the retaining member 1331 has a tapered portion 1343A shown most clearly in FIGS. 6B and 6C. Tapered portion 1343A of the retaining member 1331 corresponds with tapered portion 1319 of the locking pin 1310.

O-ring 1333 and washer 1334 are both annular. As seen in FIG. 6C, the locking ring 1332 is concentrically received inside the o-ring 1333 and abutted by washer 1334 when located in the retaining member 1331. The inner diameter of the locking ring 1332 is smaller than the inner diameter of the washer 1334 and retaining member 1331 thereby extending into the aperture 1343 of the retaining member 1331.

Figure 7B:
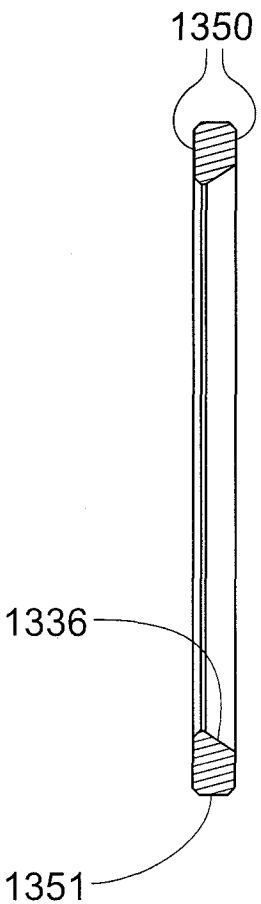
FIG. 7B shows a cross-sectional view of the locking ring shown in FIG. 7A.
Figure 7A:
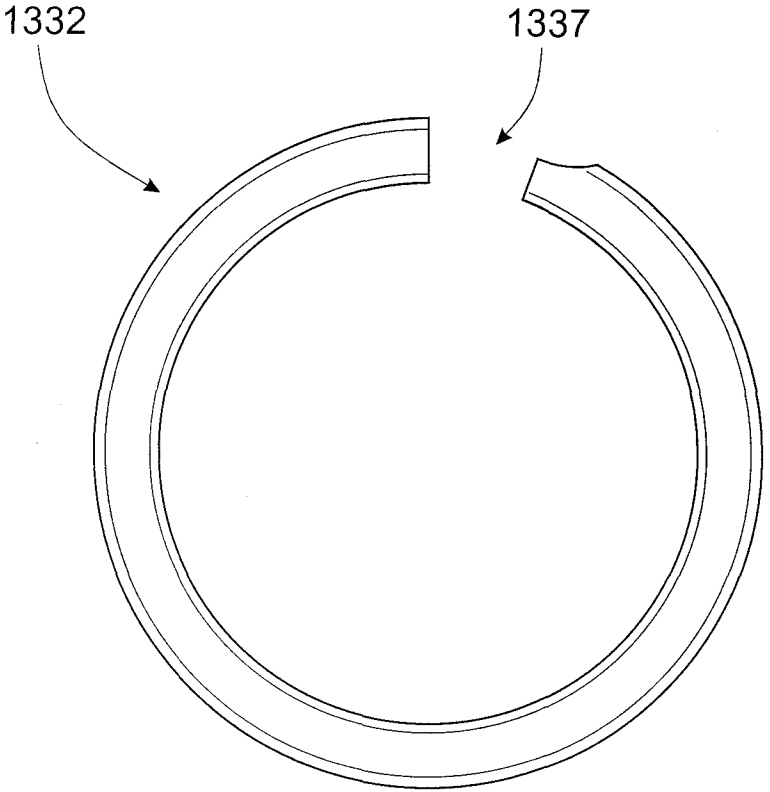
FIG. 7A shows a front elevation view of a locking ring of the retaining assembly shown in FIG. 6A.

As shown in FIGS. 7A and 7B, locking ring 1332 has parallel side walls 1350, an outer wall 1351 and an inner wall 1336. The inner wall is chamfered, providing an increasing inner diameter over the majority of the axial length of the locking ring. Locking ring 1332 is resilient and, as shown in FIG. 7A, has an opening 1337. Locking ring 1332 has an inner diameter that is smaller than the maximum outer diameter of the tapered portion 1319 of the pin 1310 but greater than the outer diameter of the groove 1318 of the pin 1310.

Figure 8A:
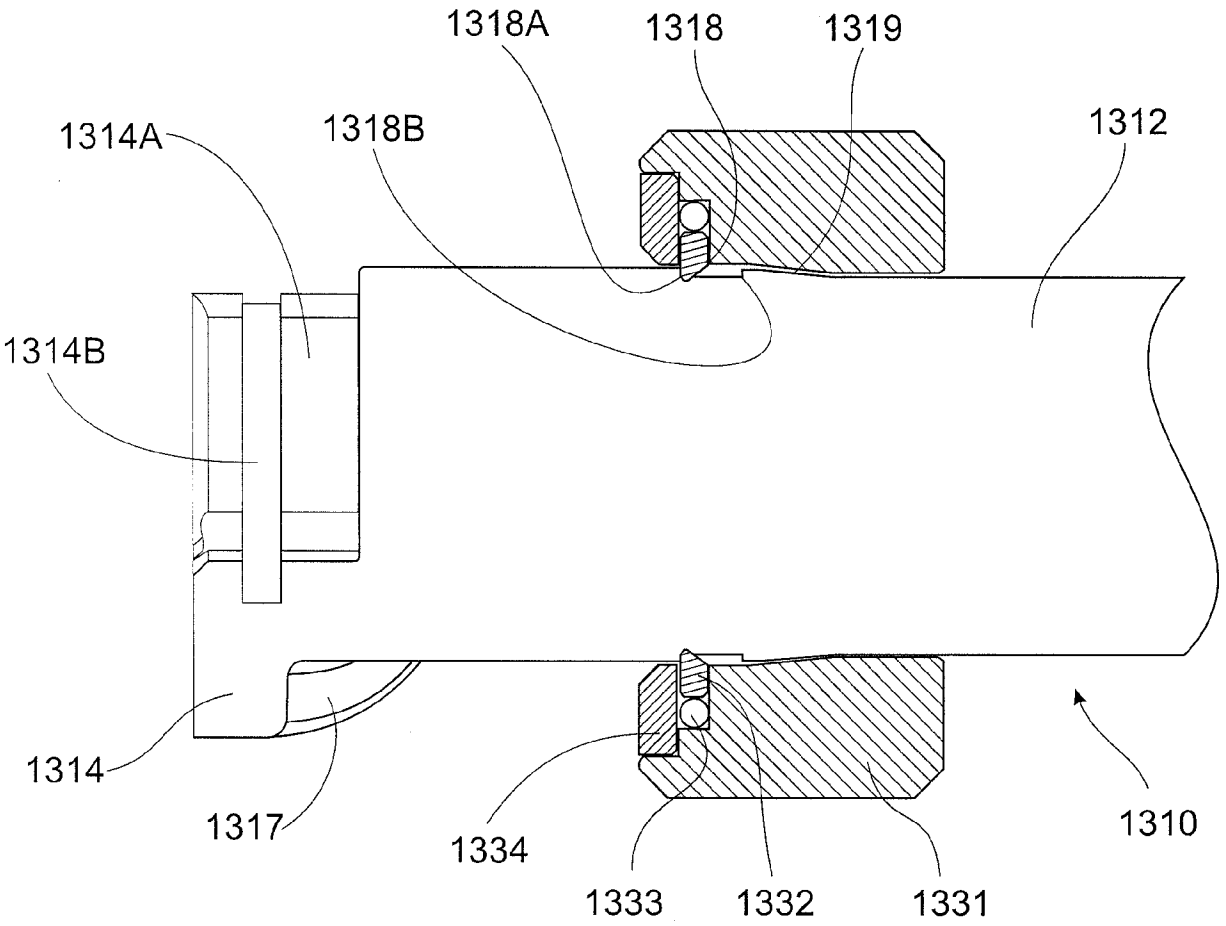
FIG. 8A shows a close-up side cross-sectional view of the locking assembly shown in FIG. 3A.
Figure 8B:
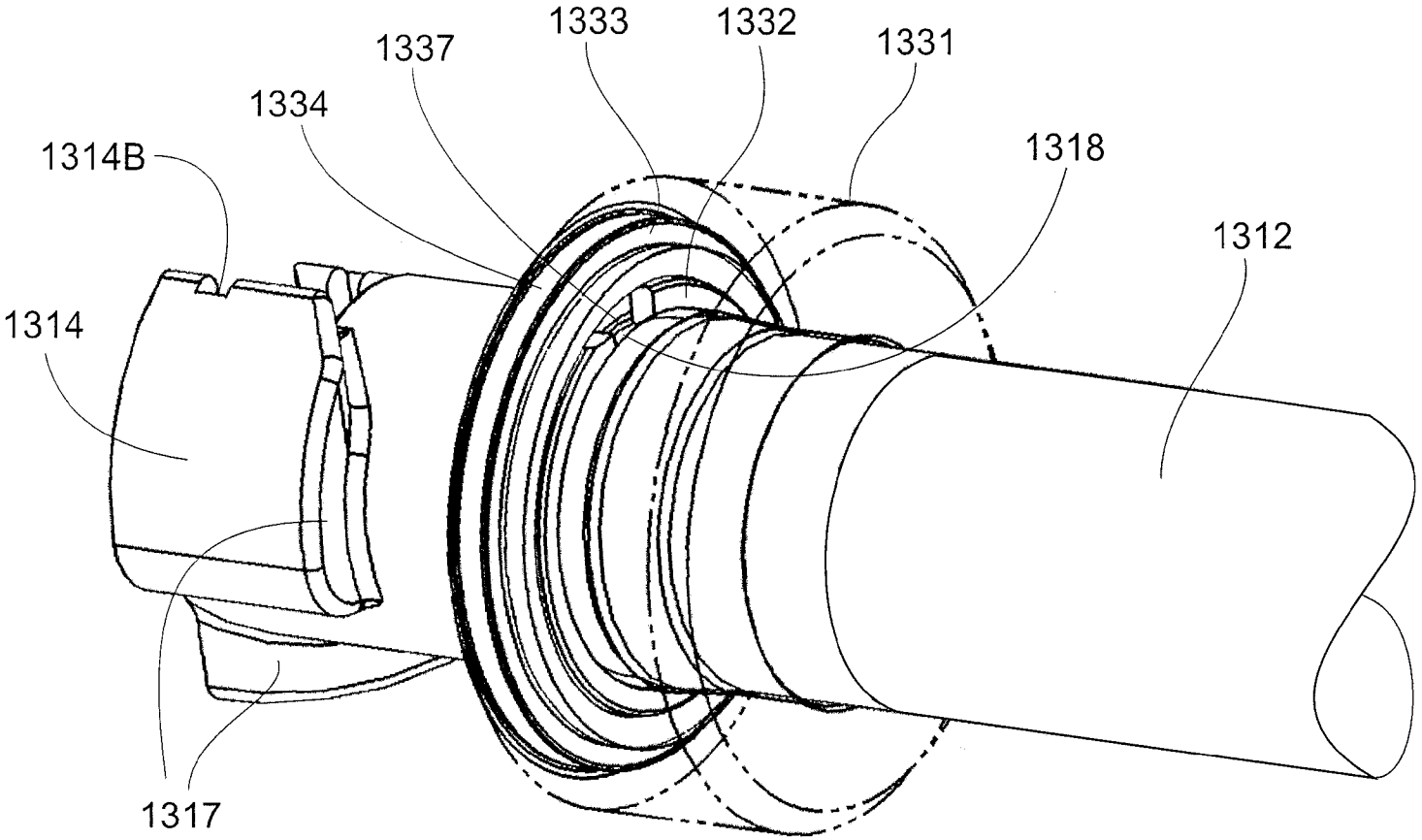
FIG. 8B shows a close-up rear perspective view of the locking assembly shown in FIG. 3A with the retaining member shown in transparency.

FIGS. 8A and 8B show the retaining assembly 1330 locked with the locking pin 1310. The resilient locking ring 1332 is located around locking pin 1310 in the groove 1318 of the flange portion 1311. Locking pin 1310 is locked longitudinally relative to the retaining assembly 1330 as the side walls 1318A and 1318B prevent the smaller inner diameter of the locking ring 1332 from passing.

Figure 9A:
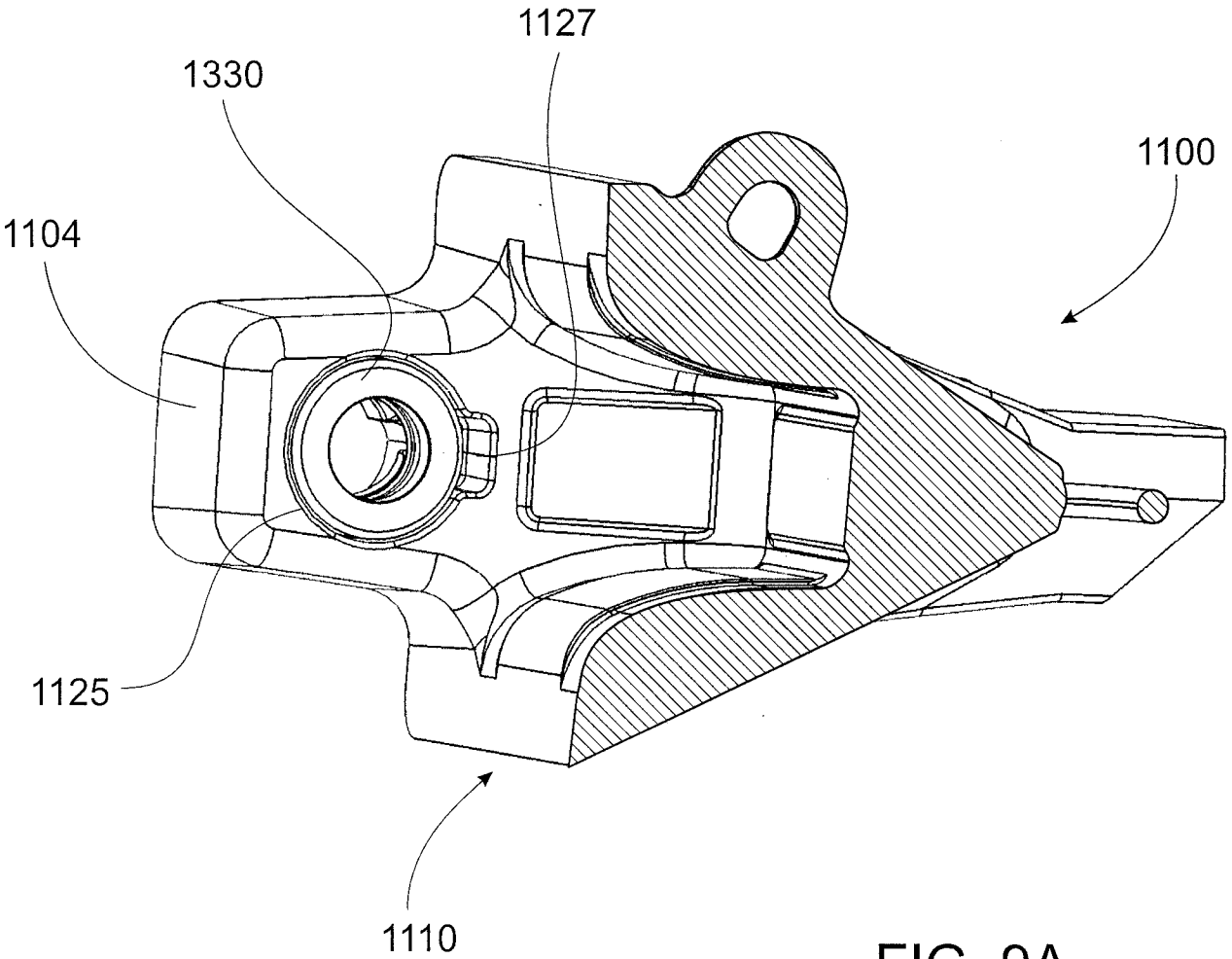
FIG. 9A shows rear sectional perspective view of the retaining assembly shown in FIG. 6A located with the tooth shown in FIG. 2A.
Figure 9B:
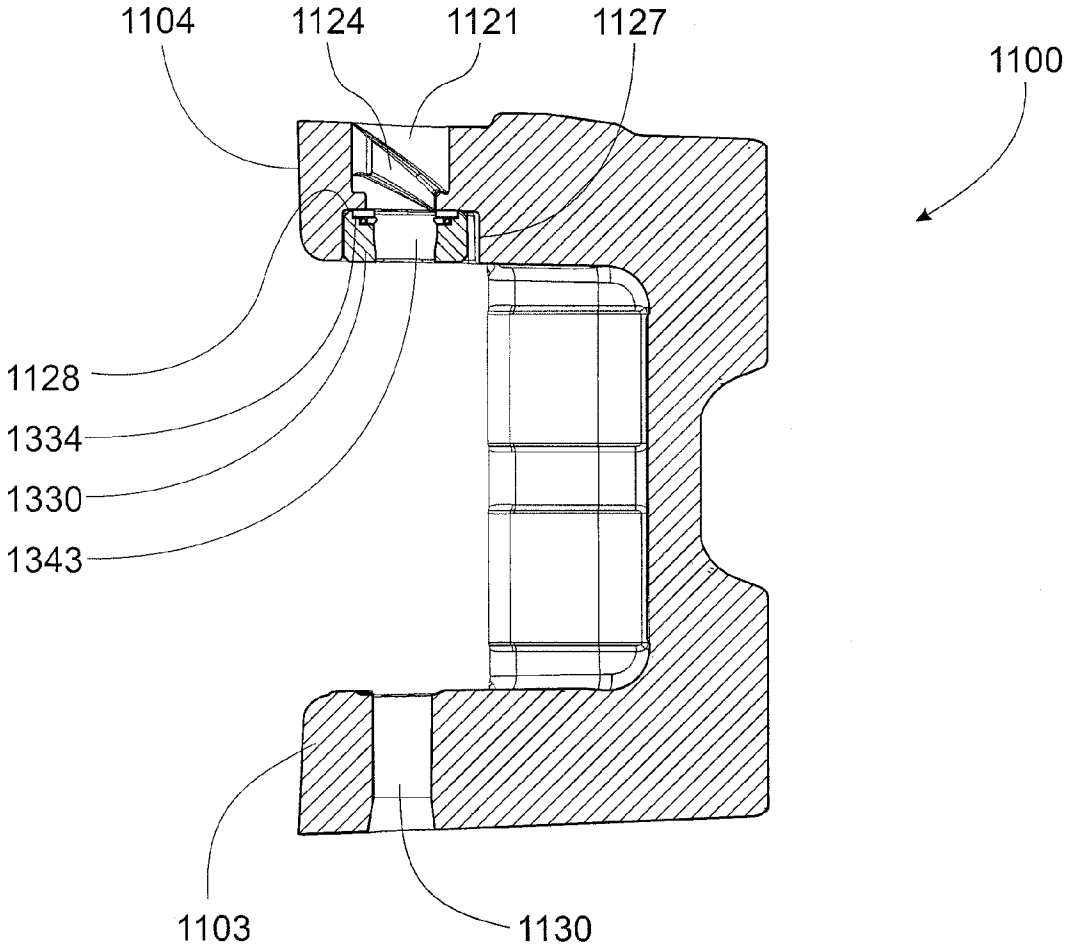
FIG. 9B shows a top cross-sectional view of the tooth and retaining assembly.

FIGS. 9A and 9B show the tooth 1100 with the retaining assembly 1330 located in the retaining recess 1125 such that washer 1334 abuts locking face 1128. Blind slot 1127 may optionally be used with a detent on the retaining assembly 1330 (shown in FIGS. 16A and 16B) to prevent rotation of the retaining assembly 1330 within the retaining recess 1125 if desired.

In an optional embodiment, retaining assembly 1330 may be permanently secured within retaining recess of locking aperture 1120 of tooth 1100 by means of a chemical fastener or the like. Alternatively, retaining assembly 1330 may be integrally formed with tooth 1100. In such an embodiment, a skilled addressee will appreciate that reference to a retaining assembly or member in this specification would be a reference to a retaining portion of the wear member in the form of tooth 1100. The locking member, preferably in the form of a locking ring 1332, would be captured inside the retaining portion of the tooth 1100 instead of being held in place by the other components of the retaining assembly 1330. Furthermore, the other components, in particularly the o-ring 1333, may also be captured inside the retaining portion of the tooth 1100. In such an embodiment the retaining ring 1332, and any other retaining components (e.g. o-ring 1333), held in the retaining portion of the tooth 1100 would effectively be integral with, and therefore replaced with, the tooth 1100.

Figure 10A:
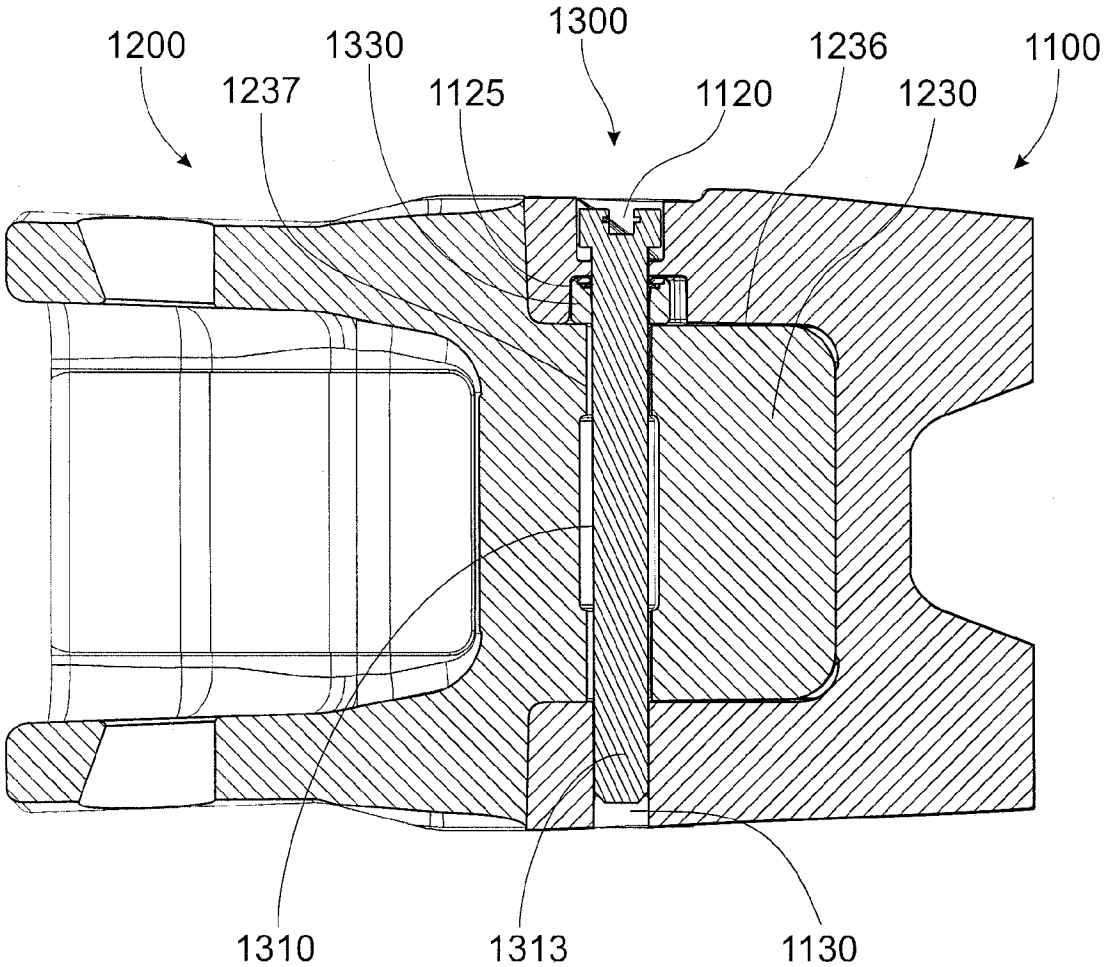
FIG. 10A shows a top cross-sectional view of the tooth located on the adaptor with the lock assembly therein.
Figure 10B:
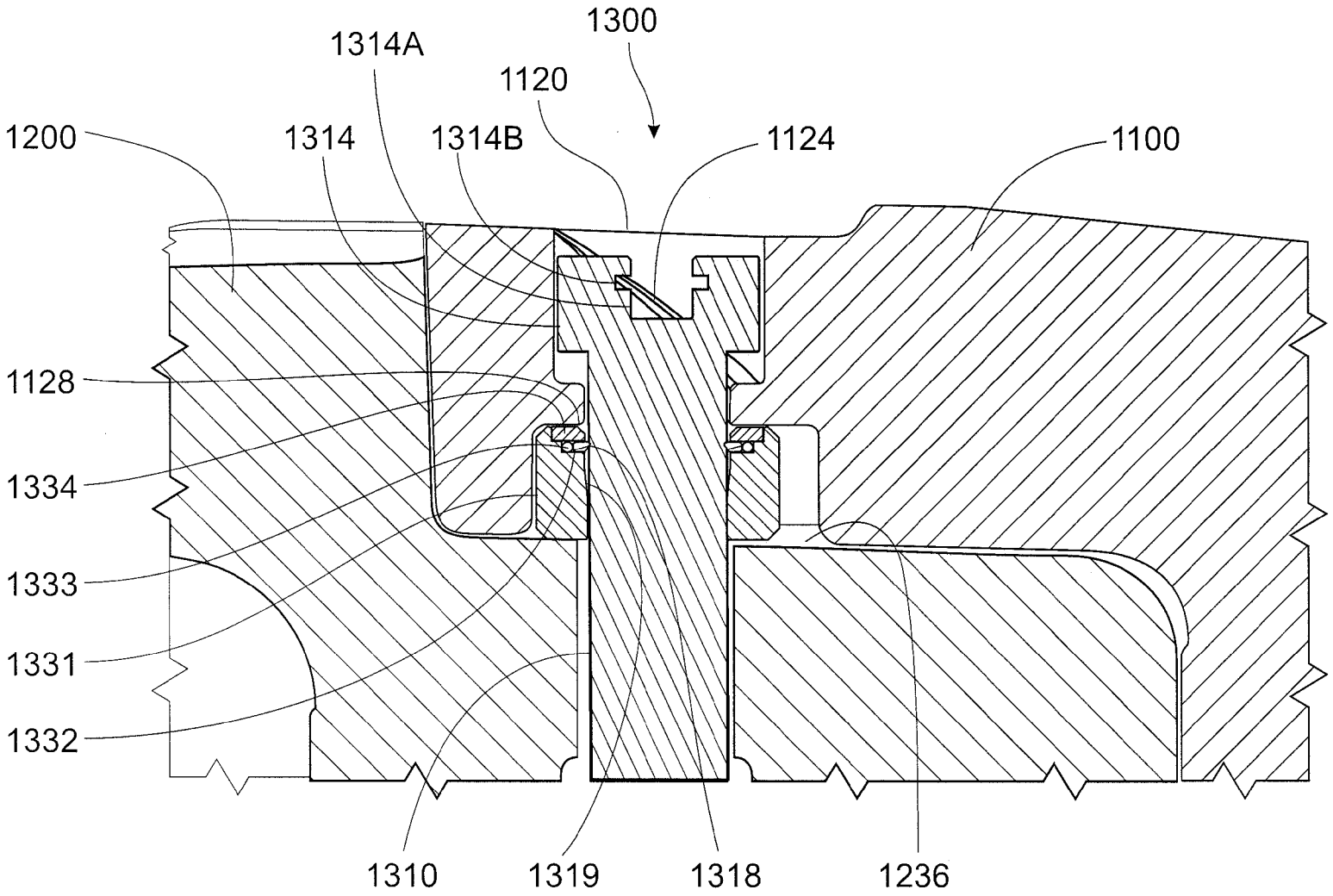
FIG. 10B shows a close-up of the retaining assembly portion of FIG. 10A.
Figures 11A, 11B:
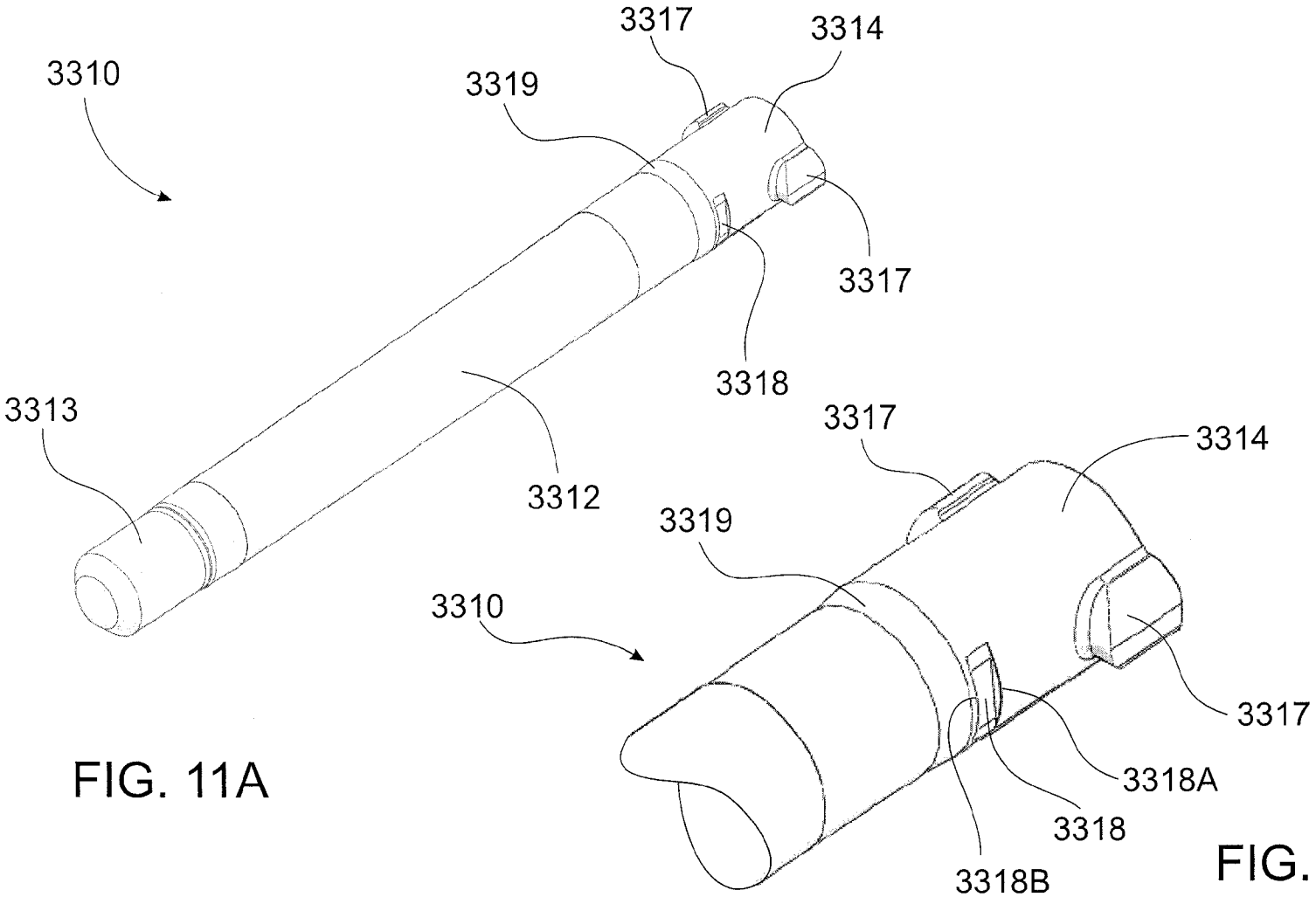
FIG. 11A shows a perspective view of a locking pin forming part of a lock assembly according to another embodiment of the invention.
FIG. 11B shows a close-up of a head portion of the locking pin shown in FIG. 11A.

The locking assembly 1300 is shown in FIGS. 10A and 10B in the locked position with the adaptor 1200 and tooth 1100 being held together by lock assembly 1300. In this position, the retaining assembly 1330 is captively retained in retaining recess 1125 of tooth 1100 in view of retaining recess 1125 being coaxial with retaining passage 1237 of adaptor 1200. In this way, bottom surface of retaining member 1331 contacts an outer face of side wall 1236 of spigot portion 1230 of the adapter 1200 to thereby captively retain retaining assembly 1330 in retaining recess 1125 of tooth 1100 as shown. Retaining pin 1310 of lock assembly 1300 is located through locking aperture 1120, retaining passage 1237 and toe aperture 1130 in the locked position to releasably retain tooth 1100 on adaptor 1200.

As seen most clearly in FIG. 10B, the retaining member 1331 is located between outer face of side wall 1236 of spigot portion 1230 of adapter 1200 and locking face 1128 at an inner end of retaining recess 1125 of tooth 1100. The locking ring 1332, concentrically located o-ring 1333, and adjacent washer 1334 are held co-axially within retaining member 1331 with the washer 1334 abutting locking face 1128 of retaining recess 1125 of tooth 1100.

Locking pin 1310 is located axially through the locking aperture 1120 of tooth 1100, retaining member 1331, locking ring 1332, o-ring 1333, washer 1334, and retaining passage 1237 of adapter 1200. Locking pin 1310 is held in place by locking ring 1332 protruding into groove 1318 of the locking pin 1310.

FIGS. 11A to 18B show a locking assembly according to an alternative embodiment of the invention. Starting at FIGS. 11A and 11B, locking pin 3310 is shown having a toe portion 3313 extending from an end of main portion 3312 distal a head portion 3314. Toe portion 3313 is adapted to be located in toe aperture 1130 of tooth 1100.

Instead of the circumferential groove 1318 of locking pin 1310, locking pin 3310 has a substantially rectangular groove 3318 which is substantially perpendicular to the longitudinal axis of the locking pin 3310. As shown most clearly in FIG. 11B, rectangular groove 3318 has opposed side walls 3318A and 3318B. The side walls 3318A and 3318B are substantially parallel to each other and are generally partially annular, separated by a flat bottom surface.

Figure 18B:
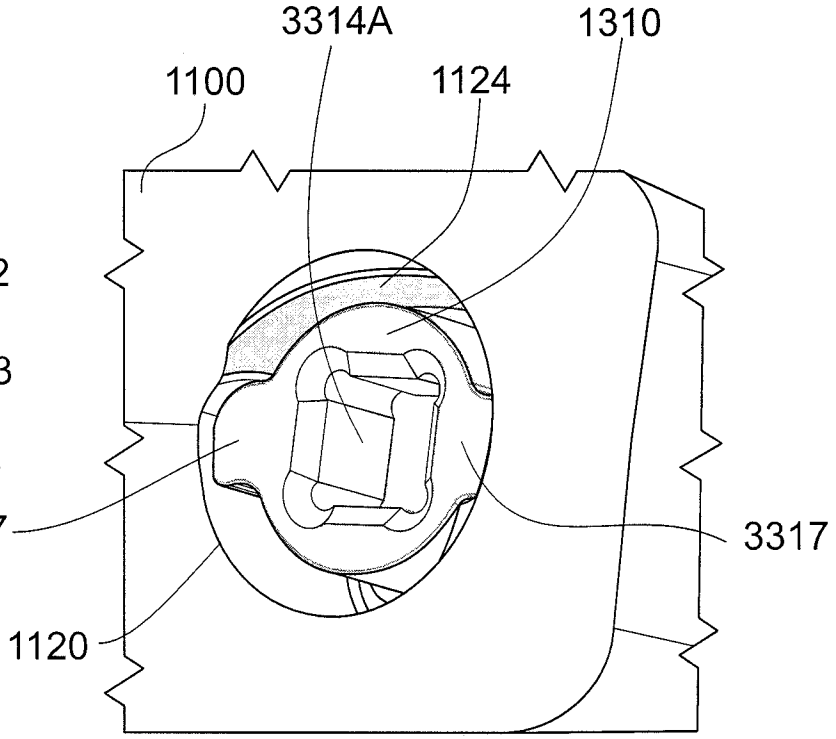
FIG. 18B shows a close-up perspective view of an outer end of the locking assembly shown in FIG. 18A.
Figure 18A:
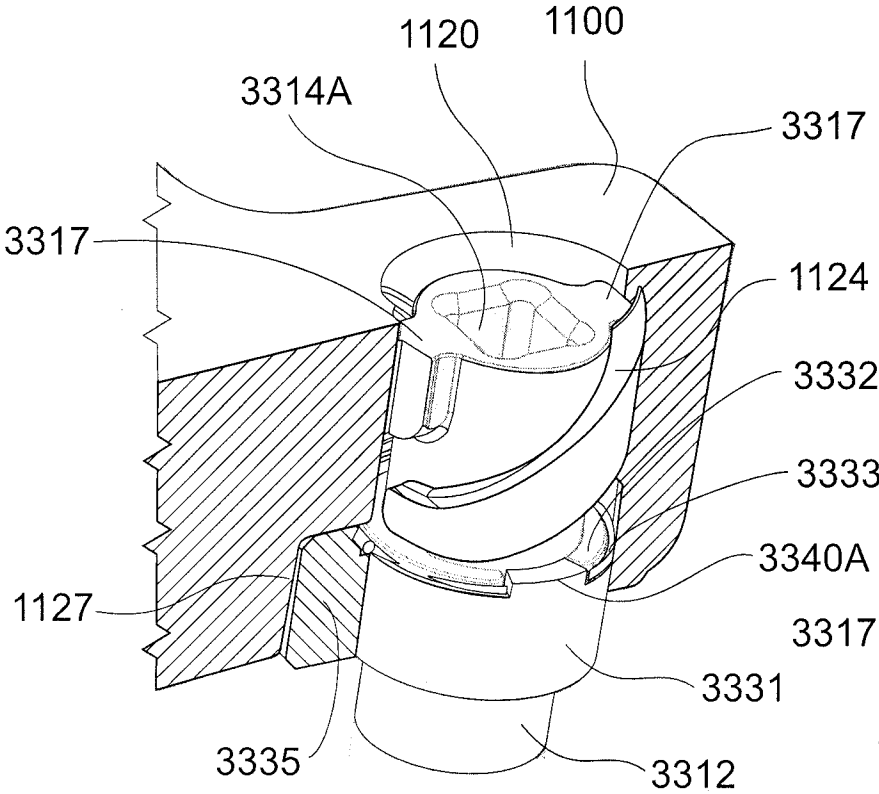
FIG. 18A shows a cut-away perspective view of the locking assembly shown in FIG. 17A fitted in a tooth.

Adjacent the substantially rectangular groove 3318 is a tapered portion 3319 that increases in diameter from the main portion 3312 of the pin 3310 to a greater diameter adjacent side wall 3318B. Head 3314 of locking pin 3310 also has shaped portions in the form of protrusions 3317. The protrusions 3317 are arranged to align with ramps 1124 of the wear member 1100. As shown in FIGS. 18A and 18B, head portion 3314 has a recess 3314A that is generally rectangular, but other shapes would also be suitable including, for example, a generally hexagonal shaped recess.

Figure 12:
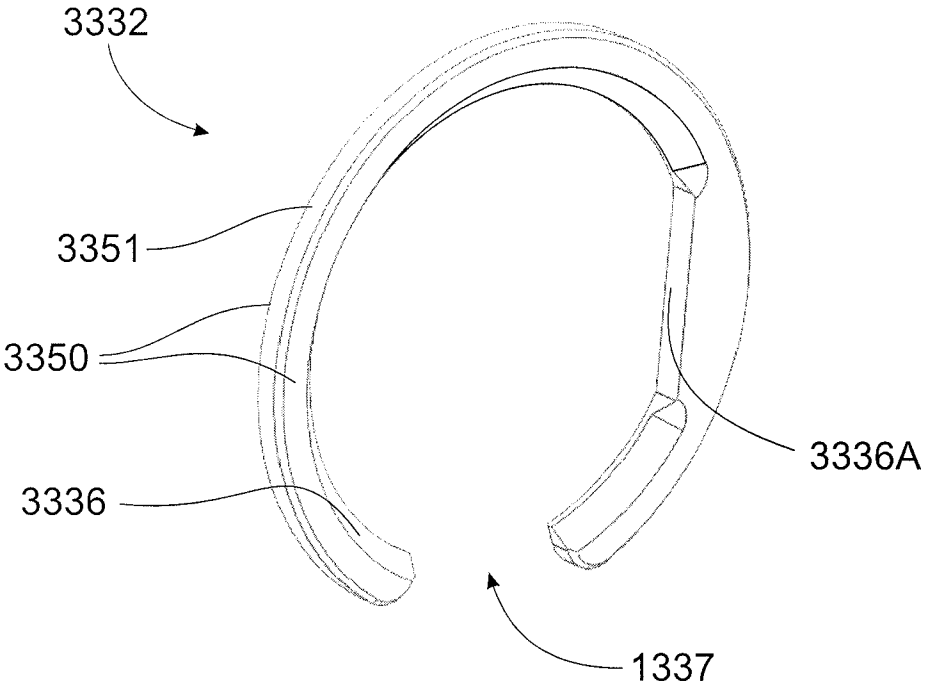
FIG. 12 shows a perspective view of a locking ring forming part of the locking assembly using the locking pin shown in FIG. 11A.

FIG. 12 shows a locking ring 3332 that has parallel side walls 3350, an outer wall 3351 and an inner wall 3336. The inner wall 3336 is chamfered, providing an increasing inner diameter over the majority of the axial length of the locking ring 3332. Locking ring 3332 is resilient and has an opening 1337.

Locking ring 3332 generally has an inner diameter that is smaller than the maximum outer diameter of the tapered portion 3319 of the pin 3310. Locking ring 3332 has a tab in the form of a flattened portion 3336A that is in the form of a segment of a circle generally across the inner wall 3336 of the locking ring. The inner diameter of the locking ring 3332 is reduced by the flattened portion 3336A. Correspondingly, the radial width of the locking ring 3332 is increased by the flattened portion 3336A. Furthermore, flattened portion 3336A is not chamfered like inner wall 3336, but rather has an inner surface that is substantially planar and perpendicular to the parallel outer walls 3350.

Figure 13:
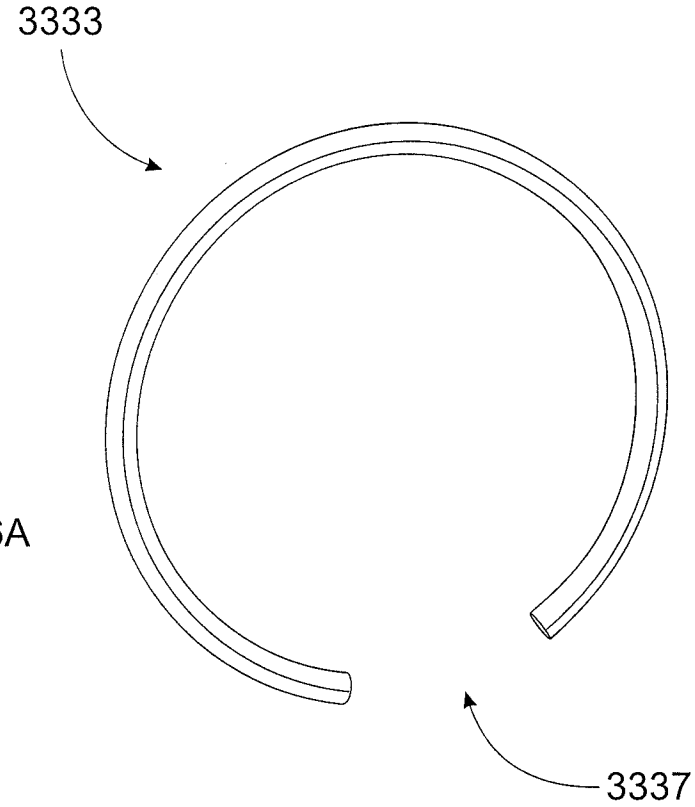
FIG. 13 shows a perspective view of a spacer forming part of the locking assembly using the locking pin shown in FIG. 11A.

FIG. 13 illustrates a spacer in the form of a partially annular o-ring 3333. O-ring 3333 has an opening 3337 which corresponds with the opening 1337 of the locking ring 3332. O-ring 3333 is made of a resiliently deformable material, and is sized to co-axially receive the locking ring 3332 within.

Figure 14:
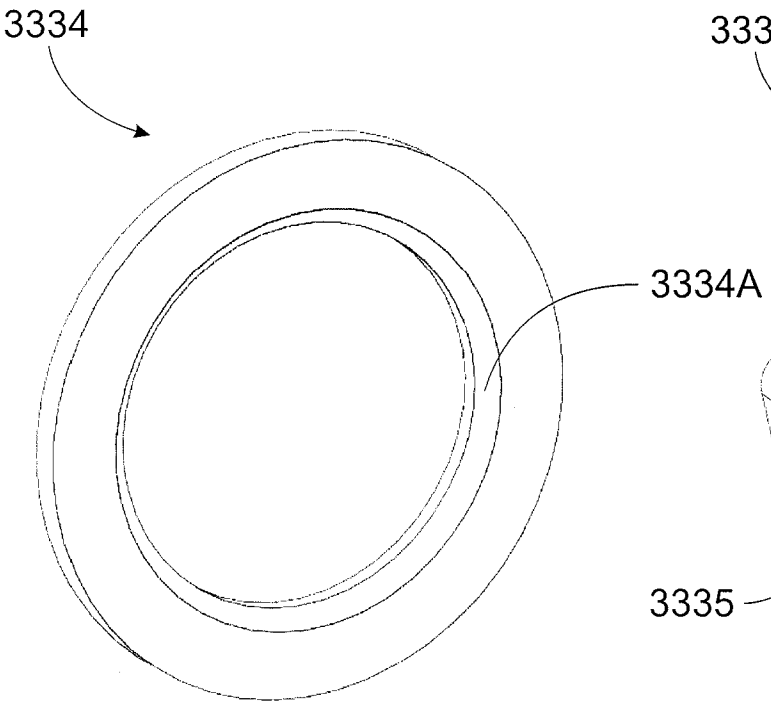
FIG. 14 shows a perspective view of a washer forming part of the locking assembly using the locking pin shown in FIG. 11A.

FIG. 14 illustrates a washer 3334 which is annular. The washer is sized such that its inner diameter is generally the same as the inner diameter of the locking ring 3332 and its outer diameter is generally the same as the inner diameter of the second seat 3333. Washer 3334 has a chamfered inner surface 3334A.

Figure 15:
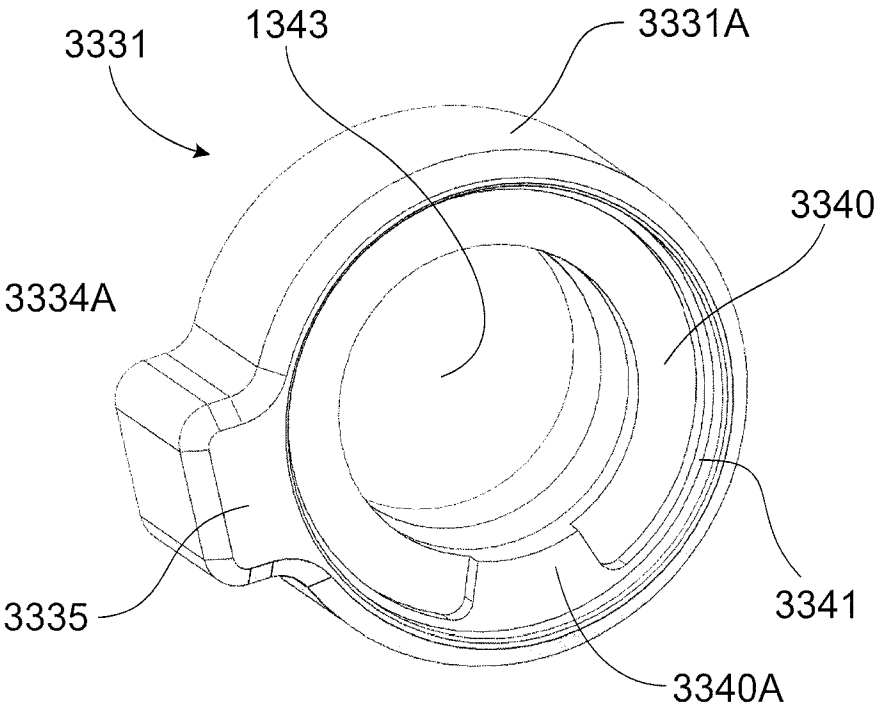
FIG. 15 shows a perspective view of a retaining member forming part of the locking assembly using the locking pin shown in FIG. 11A.

Shown in FIG. 15 is a retaining member 3331 that is generally cylindrical with a body 3331A having an aperture 1343 therein. The retaining member 3331 has a detent 3335 extending outwardly from the body 3331A of the retaining member. The detent is shaped to fit in blind slot 1127 of the wear member 1100.

Retaining member 3331 has a first seat 3340 that receives the locking ring 3332 and o-ring 3333, and a second seat 3341 that receives the washer 3334. The first seat 3340 has a boss 3340A that is a generally curved trapezoidal shape. Boss 3340A is sized approximately the size of the openings 1337 and 3337 of the locking ring 3332 and o-ring 3333, respectively. The height of the boss 3340A is the same as the height of the first seat 3340, with an upper surface of the boss 3340A being substantially coplanar with the second seat 3341.

Figure 16B:
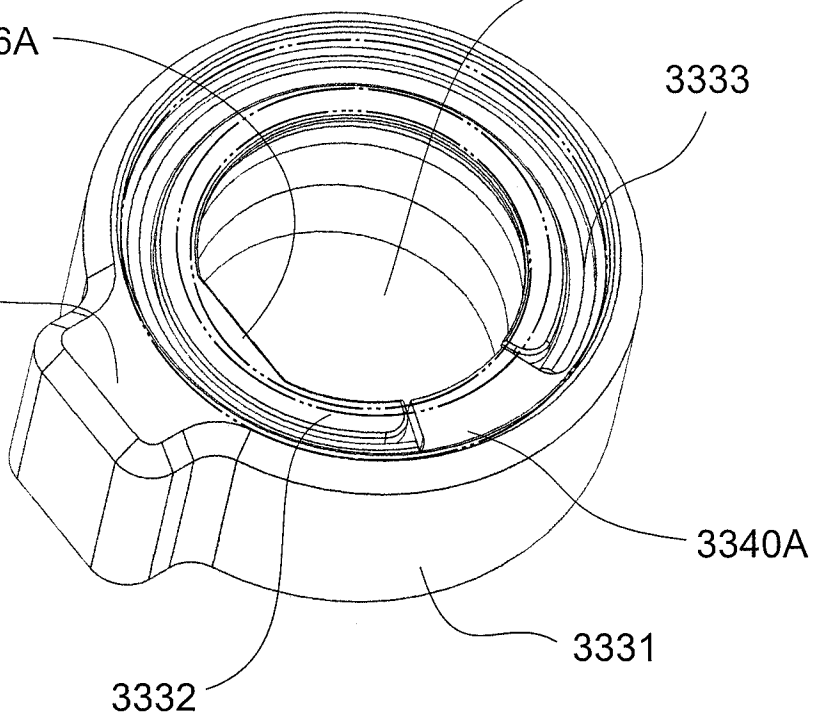
FIG. 16B shows a perspective view of the retaining assembly shown in FIG. 16A.
Figure 16A:
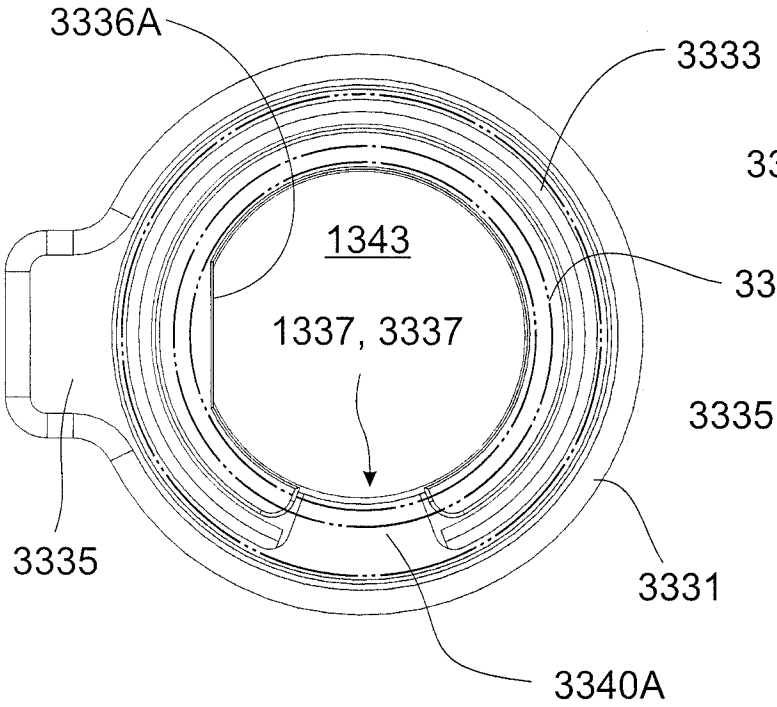
FIG. 16A shows a plan view of a retaining assembly forming part of the locking assembly using the locking pin shown in FIG. 11A.

FIGS. 16A and 16B illustrate the retaining member 3331, locking ring 3332, o-ring 3333, and washer 3334 (transparent) when arranged together. The retaining member 3331 receives the locking ring 3334 and o-ring 3333 on the first seat 3340 with the openings 1337 and 3337 being arranged around boss 3340A. The washer 3334, which is transparent in FIGS. 16A and 16B, is located on top of the locking ring 3334 and o-ring 3333 on the second seat 3341 of the retaining member 3331.

Notably, the flattened portion 3336A of the locking ring 3334 protrudes into the aperture 1343 of retaining member 3331. The boss 3340A of the retaining member 3331 ensures that the locking ring 3334 is located in a particular orientation such that the flattened portion 3336A of the locking ring 3334 is located at a predetermined location in the aperture 1343 of the retaining member 3331. In the illustrated embodiment, this predetermined location is the portion of the aperture 1343 that is adjacent the detent 3335 of the retaining member 3331.

Figure 17B:
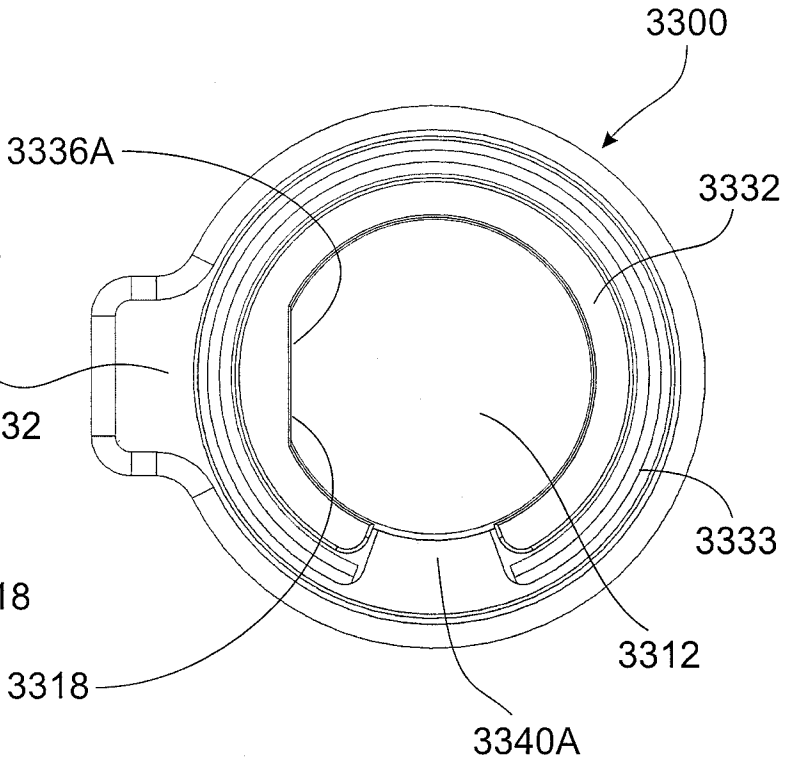
FIG. 17B shows a cross-sectional plan view of the locking assembly shown in FIG. 17A.
Figure 17A:
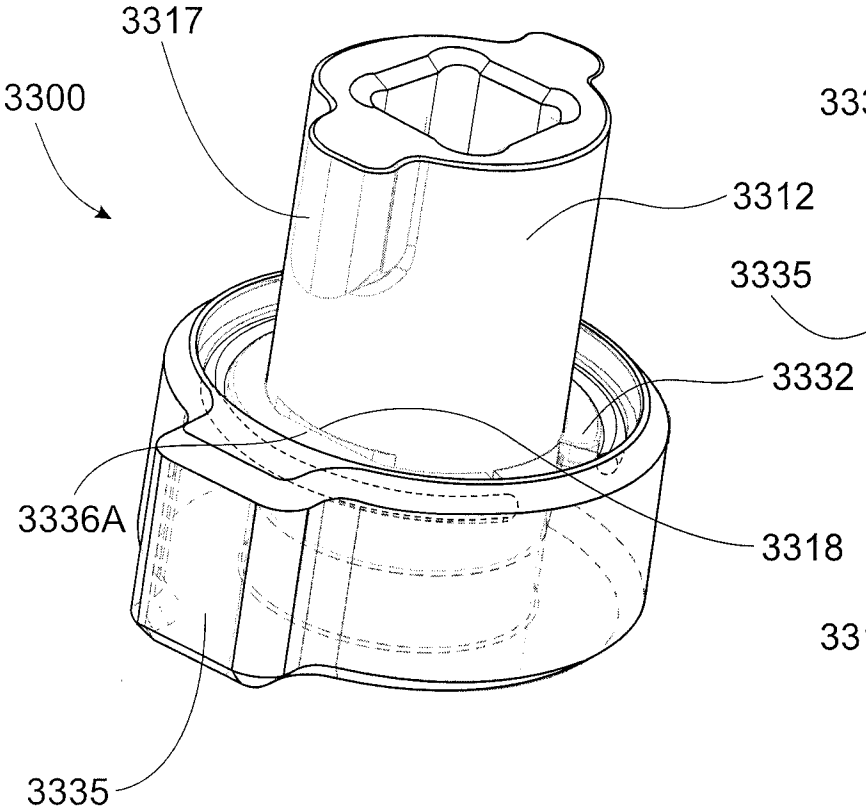
FIG. 17A shows a partially transparent perspective view of the locking assembly using the locking pin shown in FIG. 11A.

FIG. 17A shows a view of lock assembly 3300 including retaining member 3331 (transparent), locking ring 3332, and o-ring 3333 when engaged with the locking pin 3310 in a locked position. FIG. 17B is a cross sectional plan view of the lock assembly 3300 in FIG. 17A. As can be seen in FIGS. 17A and 17B, the flattened portion 3336A of the locking ring 3332 corresponds to, and is received by. the rectangular groove 3318 of the locking pin 3312.

The substantially planar surface of flattened portion 3336A abuts the flat bottom surface of the rectangular groove 3318, seen most clearly in FIG. 17B. The locking ring 3332 is prevented from rotating due to boss 3340A of the retaining assembly 3331 which in turn prevents rotation of the locking pin 3312, when received in the locked position as shown in FIGS. 17A and 17B, by abutment of the flattened portion 3336A of the locking ring 3332 with the flat bottom surface of the rectangular groove 3318 of the locking pin 3312.

The inner diameter of the locking ring 3332 is smaller than the outer diameter of the locking pin 3312 around the rectangular groove 3318, causing the locking ring 3332 to expand radially to receive the locking pin 3312 and hold the flattened portion 3336A under pressure in the rectangular groove 3318.

FIG. 18A shows a cut-away view of the retaining member 3331 when located in the retaining recess 1125 of the wear member 1100. Detent 3335 of the retaining member 3331 can be seen located in blind slot 1127 of the retaining recess 1125. FIG. 18B shows a close-up perspective view of an outer end of the locking pin 1310 in the locking aperture 1120 of the wear member 1100.

To retain the tooth 1100 on the adaptor 1200, the tooth 1100 is slidably mounted onto adaptor 1200 such that spigot portion 1230 is located within socket cavity 1110 of tooth 1100. The locking pin 1310, 3310 of lock assembly 1300, 3300 is then located adjacent locking aperture 1120.

In order to move the lock assembly 1300, 3300 from an unlocked position to a locked position, thereby releasably securing tooth 1100 on adaptor 1200, toe portion 1313, 3313 of locking pin 1310, 3310 is first located through locking aperture 1120 of tooth 1100. Toe portion 1313, 3313 travels through receiving passage 1121 of locking aperture 1120, aligned aperture 1343, 3343 of retaining member 1331, 3331 and into retaining passage 1237 of spigot portion 1230 of adaptor 1200.

As locking pin 1310, 3310 is inserted into the aligned apertures the main body portion 1312, 3312 of the locking pin 1310, 3310 slides relative to the locking ring 1332, 3332 until the tapered portion 1319, 3319 reaches the locking ring 1332, 3332. The inner diameter of the locking ring 1332, 3332 is smaller than the outer diameter of at least a portion of the tapered portion 1319, 3319 and, accordingly, as the locking pin 1310, 3310 is inserted further the tapered portion 1319, 3319 forces the resilient locking ring 1332, 3332 to deform perpendicularly to the longitudinal axis of the locking pin 1310, 3310 to allow the locking pin 1310, 3310 to pass. The locking ring 1332. 3332 deforms by expanding axially which increases the opening 1337 and compresses the concentric o-ring 1333, 3333 into seat 1340, 3340 of retaining member 1331, 3331.

Once sidewall 1318B, 3318B of flange portion 1311, 3311 of the locking pin 1310, 3310 reaches the locking ring 1332, 3332 the ring contracts into the groove 1318, 3318 of the locking pin 1310, 3310. At this point, the locking pin 1310, 3310 is releasably locked in the longitudinal axis by the locking ring 1332, 3332, and prevents removal of the tooth 1100 from the adapter 1200 as shown in FIGS. 10A and 10B. To allow the pin 1310, 3310 to reach this point, ramps 1317 or protrusions 3317 of pin head 1314, 3314 must be aligned with the corresponding ramps 1124 of the tooth 1100. This may be done prior to insertion or the pin ramps 1317 or protrusions 3317 and tooth ramps 1124 can engage with each other to rotate the pin axially under longitudinal insertion force as the locking pin 1310, 3310 is inserted.

The embodiments of the locking assembly 1300, 3300 and tooth 1100 discussed above have particular advantages when it is time to replace tooth 1100 due to wear.

First locking pin 1310, 3310 is required to be removed. Locking pin 1310, 3310 may be removed in two ways, namely by rotation or prying. To remove locking pin 1310, 3310 by rotation, a tool is then used to axially rotate locking pin 1310, 3310 such that ramps 1317 of the locking pin 1310 or protrusions 3317 of the locking pin 3310 engage with ramps 1124 of the tooth 1100 to translate the rotational force to longitudinal force to urge locking pin 1310, 3310 to eject outwardly of locking aperture 1120. Additionally, or alternatively, the locking pin 1310, 3310 may be pried with a pry tool. Trough 1314B (illustrated in relation to locking pin 1310 only) may be utilised to purchase the pin, and open end of recess 1314A may be utilised to allow the tool to lever off another surface, such as off the tooth 1100.

As tooth 1310, 3310 is drawn from tooth 1100, locking ring 1332, 3332 abuts side wall 1318B, 3318B, providing resistance to removal. As removal forces increase, chamfered inner wall 1336, 3336 of the locking ring 1332, 3332 engages, and slides over, side wall 1318B, 3318B causing the resilient locking ring 1332, 3332 to expand. As the locking ring 1332, 3332 expands the o-ring 1333, 3333 compresses and the pin 1310, 3310 is able to be removed from the retaining assembly. An outward end of locking pin 1310, 3310 is then available in order to draw the locking pin entirely from the aligned apertures and thus remove tooth 1100 from adaptor 1200.

Locking pin 2310, as shown in FIGS. 5A to 5C, operates in the same manner but is directed towards removal by prying, particularly by using the pry rope 2320 to pry the locking pin 2310 from the retaining assembly 1330 and aligned apertures. A pry tool may be passed under the pry rope 2320 and levered off another surface, such as off the tooth 1100, to pry the locking pin 2310 from its locked position.

The ejection of locking pin 1310, 2310, 3310 from locking aperture 1120 as with the lock assembly 1300, 3300 described herewith is particularly advantageous in circumstances where the locking pin 1310, 2310, 3310 becomes cemented within retaining passage 1237 of spigot portion 1230 of adaptor 1200 through ingress of fines and moisture. In this regard, the retaining assemblies are relatively well protected from ingress. Even if fines penetrate the locking assemblies and accumulate in groove 1318, 3318 of locking pin 1310, 3310 they can be overcome during removal by chamfered inner side 1336, 3336 of the locking ring 1332, 3332 by expanding the locking ring 1332, 3332 to accommodate the fines.

Furthermore, the tapered portion 1319, 3319 of the locking pin 1310, 3310 ensures that once any initial cementation is broken, the pin may be withdrawn without any further significant frictional effects between the faces of the locking pin 1310, 3310 and the faces of the aperture and passage.

The excavator wear assembly of the invention and the lock assembly for securing the wear member in the form of a tooth to an adaptor avoid the need for threaded components and complex parts. In this way, the invention provides for an effective method of releasably securing the tooth to the adaptor.

Throughout the specification the aim has been to describe the invention without limiting the invention to any one embodiment or specific collection of features. Persons skilled in the relevant art may realise variations from the specific embodiments that will nonetheless fall within the scope of the invention. Although the invention has been described with respect to wear assemblies, it will be appreciated that the locking assembly could apply to other systems such as, for example, in connecting portions of dragline assemblies, and the like.

It will be appreciated that various other changes and modifications may be made to the embodiment described without departing from the spirit and scope of the invention.

In this specification, where different embodiments share identical features, common reference numbers are used to identify those identical features.

The invention claimed is:

1. A lock assembly for an excavator wear assembly, the lock assembly comprising:

a locking pin having a flange portion and a longitudinal axis; and a retaining assembly having a locking member with a tab, the retaining assembly being adapted to receive the locking pin;

wherein the locking member of the retaining assembly is adapted to deform perpendicularly to the longitudinal axis of the locking pin as the locking pin is inserted longitudinally into the retaining assembly;

wherein the locking member of the retaining assembly is adapted to engage with the flange portion of the locking pin to prevent withdrawal of the locking pin from the retaining assembly when the lock assembly is in a locked position; and wherein the tab is in the form of a segment of a circle generally across an inner wall of the locking member and the tab engages the flange portion in a manner to assist in preventing relative rotation therebetween.

2. The lock assembly of claim 1, wherein the locking member is a resilient locking ring.

3. The lock assembly of claim 2, wherein the resilient locking ring is substantially annular with an opening.

4. The lock assembly of claim 2, wherein the locking ring is partially annular with an opening which has a circumferential extent of less than 45°.

5. The lock assembly of claim 4, wherein the locking ring extends circumferentially approximately 330° to 340° with a respective 30° to 20° opening.

6. The lock assembly of claim 2, wherein the tab forms a segment of an inner surface across the locking ring.

7. The lock assembly of claim 6, wherein the tab includes a substantially planar portion of the inner surface.

8. The lock assembly of claim 6, wherein the tab is a flattened portion.

9. The lock assembly of claim 6, wherein the inner surface of the locking ring is chamfered except for the tab.

10. The lock assembly of claim 6, wherein the tab is located approximately 90° from the opening.

11. The lock assembly of claim 6, wherein the tab increases the radial width of the locking ring.

12. The lock assembly of claim 1, wherein the locking pin has a head portion.

13. An excavator wear member for use with a lock assembly as claimed in claim 1, the excavator wear member comprising:

a locking aperture extending through a side wall of the excavator wear member, the locking aperture having a receiving passage and a retaining recess; wherein, the receiving passage extends inwardly from an outer face of the side wall and the retaining recess is located in an inner face of the side wall such that the receiving passage terminates at the retaining recess; and the retaining assembly of the lock assembly located within the retaining recess;

wherein the locking aperture and retaining assembly located in the retaining recess are adapted to receive the locking pin of the lock assembly.

14. The lock assembly of claim 3, wherein the retaining assembly includes a retaining member having a boss to engage with the opening.

15. The lock assembly of claim 4, wherein the retaining assembly includes a retaining member having a boss to engage with the opening.

16. A lock assembly for an excavator wear assembly, the lock assembly comprising:

a locking pin having a flange portion and a longitudinal axis, wherein at least a portion of the flange portion is substantially perpendicular to the longitudinal axis; and a retaining assembly having a locking member with a tab, the retaining assembly being adapted to receive the locking pin;

wherein the locking member of the retaining assembly is adapted to deform perpendicular to the longitudinal axis of the locking pin as the locking pin is inserted longitudinally into the retaining assembly;

wherein the tab of the locking member is adapted to engage with the flange portion of the locking pin to prevent withdrawal of the locking pin from the retaining assembly when the lock assembly is in a locked position; and wherein the tab is in the form of a segment of a circle generally across an inner wall of the locking member and the tab engages the flange portion in a manner to assist in preventing relative rotation therebetween.

17. The lock assembly of claim 16, wherein the retaining assembly includes a retaining member having a boss to engage with an opening of the locking member.

* * * * *